US008193714B2

(12) United States Patent
Ohno

(10) Patent No.: US 8,193,714 B2
(45) Date of Patent: Jun. 5, 2012

(54) LIGHT-EMITTING DEVICE INCLUDING LIGHT-EMITTING THYRISTOR ARRAY, LIGHT-EMITTING ELEMENT CHIP INCLUDING LIGHT-EMITTING THYRISTOR ARRAY AND LIGHT EMISSION ADJUSTING METHOD FOR A LIGHT-EMITTING THYRISTOR ARRAY

(75) Inventor: Seiji Ohno, Tokyo (JP)

(73) Assignee: Fuji Zerox Co., Ltd., Tokyo (JP)

( * ) Notice: Subject to any disclaimer, the term of this patent is extended or adjusted under 35 U.S.C. 154(b) by 388 days.

(21) Appl. No.: 12/467,362

(22) Filed: May 18, 2009

(65) Prior Publication Data

US 2010/0117557 A1 May 13, 2010

(30) Foreign Application Priority Data

Nov. 11, 2008 (JP) ..... 2008-289208

(51) Int. Cl.
*G09G 3/10* (2006.01)

(52) U.S. Cl. ..... 315/169.3; 347/237; 347/238

(58) Field of Classification Search .... 315/169.1–169.4, 315/294; 347/237, 238, 247, 248, 249, 224, 347/118
See application file for complete search history.

(56) References Cited

U.S. PATENT DOCUMENTS 5,969,744 A * 10/1999 Sakashita et al. ..... 347/237
6,069,644 A * 5/2000 Tanioka et al. ..... 347/238
6,703,790 B2 * 3/2004 Ohno ..... 315/169.3
7,286,259 B2 * 10/2007 Ohno et al. ..... 358/1.8
2007/0058030 A1 * 3/2007 Nagumo ..... 347/247
2011/0164103 A1 * 7/2011 Kii ..... 347/118

FOREIGN PATENT DOCUMENTS

| | | |
|---|---|---|
| EP | 2 006 918 | 12/2008 |
| JP | 2001-219596 | 8/2001 |
| JP | 2004-195796 | 7/2004 |
| JP | 2008-177513 | 7/2008 |
| WO | WO 2007097347 A1 * | 8/2007 |

* cited by examiner

*Primary Examiner* — Douglas W Owens
*Assistant Examiner* — Amy Yang
(74) *Attorney, Agent, or Firm* — Fildes & Outland, P.C.

(57) ABSTRACT

The light-emitting device includes: a setting unit switching a potential difference between anode and cathode electrodes alternately between first and second potential differences so that light-emitting thyristors are caused to have one of the first and second potential differences in common; a specifying unit sequentially specifying, as a target for controlling, one light-emitting thyristor; a supply unit alternately supplying transition voltage for causing specified light-emitting thyristor to transition from the off state to the on state and maintaining voltage for keeping the thyristor being in the off state to a gate electrode of the thyristor, in a light-emission control period during which the specifying unit specifies the target and the setting unit sets the second potential difference; and an adjusting unit that adjusts a light-emitting period of the one light-emitting thyristor by supplying the maintaining voltage and stopping supplying the voltage at a variable timing, in the light-emission control period.

10 Claims, 16 Drawing Sheets

LIGHT-EMITTING DEVICE INCLUDING LIGHT-EMITTING THYRISTOR ARRAY, LIGHT-EMITTING ELEMENT CHIP INCLUDING LIGHT-EMITTING THYRISTOR ARRAY AND LIGHT EMISSION ADJUSTING METHOD FOR A LIGHT-EMITTING THYRISTOR ARRAY

CROSS REFERENCE TO RELATED APPLICATIONS

This application is based on and claims priority under 35 USC §119 from Japanese Patent Application No. 2008-289208 filed Nov. 11, 2008.

BACKGROUND

1. Technical Field

The present invention relates to a light-emitting device and a light-emitting element chip which each include plural light-emitting thyristors, and a light emission adjusting method.

2. Related Art

In an electrophotographic image forming apparatus such as a printer, a copy machine or a facsimile machine, an image is formed on a recording paper sheet as follows. Firstly, an electrostatic latent image is formed on a charged photoconductor by causing an optical recording unit to emit light on the basis of image information. Then, the electrostatic latent image is made visible by being developed with toner. Lastly, the toner image is transferred on and fixed to the recording paper sheet. As such an optical recording unit, in addition to an optical-scanning recording unit that performs exposure by laser scanning in a first scan direction using a laser beam, an optical recording unit using the following light-emitting element head has been employed in recent years. This light-emitting element head includes a large number of light-emitting element chips arrayed in a first scan direction, and each light-emitting element chip includes a light-emitting element array formed of light-emitting elements such as light emitting diodes (LEDs) arrayed in a line.

SUMMARY

According to an aspect of the present invention, there is provided a light-emitting device including: a light-emitting thyristor array that includes plural light-emitting thyristors each having an anode electrode, a cathode electrode and a gate electrode, each of the plural light-emitting thyristors emitting light by transitioning from an off state to an on state, each of the plural light-emitting thyristors conducting between the anode electrode and the cathode electrode when turned on in order to be in the on state, while not conducting when turned off in order to be in the off state; a setting unit that switches a potential difference between the anode electrode and the cathode electrode of each of the plural light-emitting thyristors alternately between a first potential difference and a second potential difference so that the plural light-emitting thyristors are caused to have one of the first potential difference and the second potential difference in common, the second potential difference having a larger absolute value than the first potential difference; a specifying unit that sequentially specifies, as a target for controlling whether or not to emit light, one light-emitting thyristor from the plural light-emitting thyristors; a supply unit that alternately supplies a transition voltage and a maintaining voltage to the gate electrode of one light-emitting thyristor specified as the target by the specifying unit, in a light-emission control period during which the specifying unit specifies the one light-emitting thyristor as the target, and during which the setting unit causes the plural light-emitting thyristors to have the second potential difference, the transition voltage being a voltage for causing the one light-emitting thyristor to transition from the off state to the on state, the maintaining voltage being a voltage for keeping the one light-emitting thyristor being in the off state; and an adjusting unit that adjusts a light-emitting period of the one light-emitting thyristor by supplying the gate electrode of the one light-emitting thyristor with the maintaining voltage instead of the transition voltage to prevent the one light-emitting thyristor from starting emitting light in the light-emission control period, and by stopping supplying the maintaining voltage at a variable timing in the light-emission control period.

BRIEF DESCRIPTION OF THE DRAWINGS

Exemplary embodiment(s) of the present invention will be described in detail based on the following figures, wherein.

DETAILED DESCRIPTION (First Exemplary Embodiment)

Figure 1:
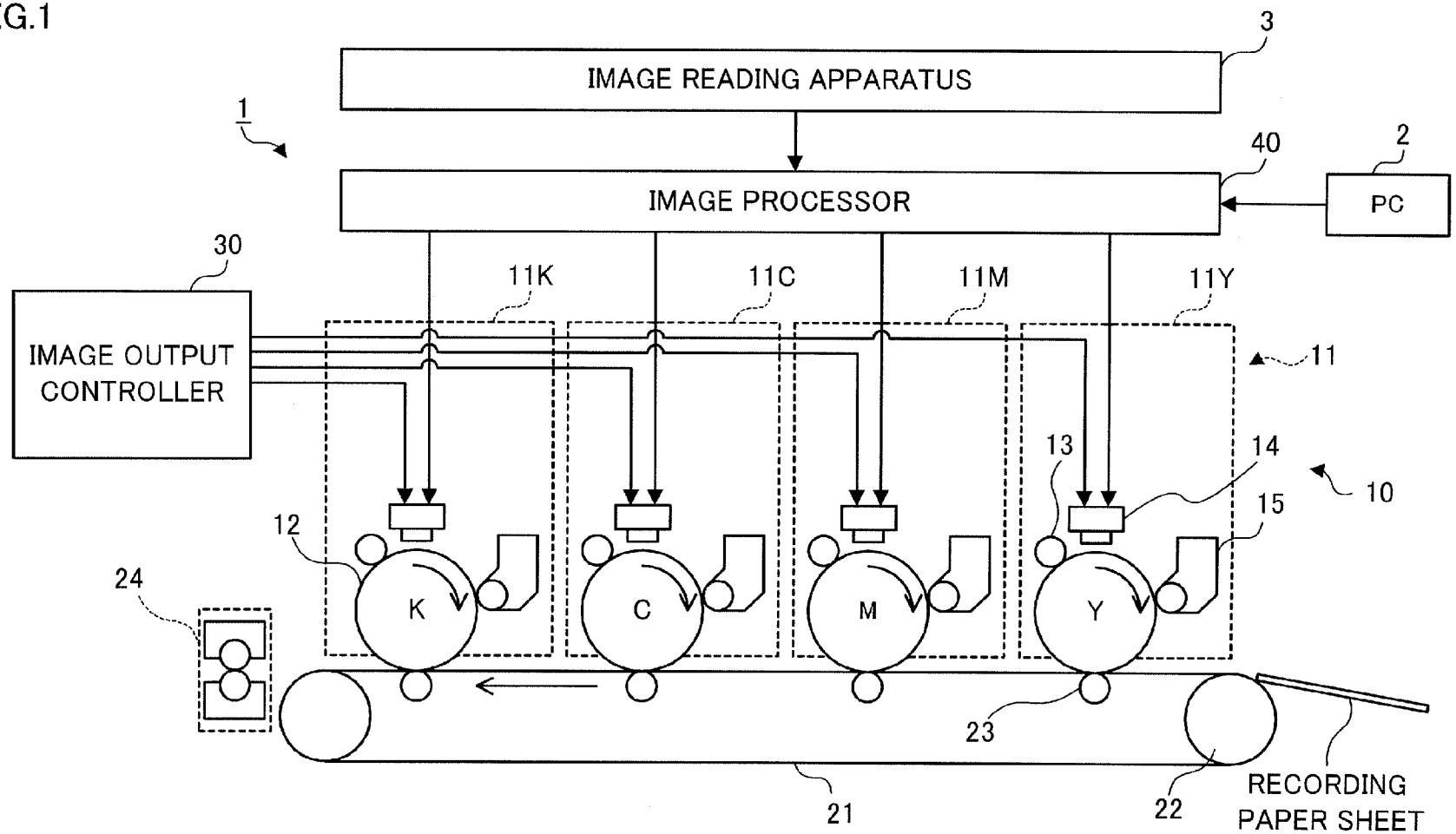
FIG. 1 shows an overall configuration of an image forming apparatus to which the first exemplary embodiment is to be applied.

FIG. 1 shows an overall configuration of an image forming apparatus 1 to which the first exemplary embodiment is to be applied.

The image forming apparatus 1 shown in FIG. 1 is generally called a tandem type image forming apparatus and the image forming apparatus 1 includes an image processing system 10, an image output controller 30 and an image processor 40. The image processing system 10 forms an image in accordance with different color tone datasets. The image output controller 30 controls the image processing system 10. The image processor 40, which is connected to devices such as a personal computer (PC) 2 and an image reading apparatus 3, performs predetermined image processing on image data received from the above devices.

The image processing system 10 includes image forming units 11. The image forming units 11 are formed of multiple engines arranged in parallel at intervals in the horizontal direction. Specifically, the image forming units 11 are composed of four units: a yellow (Y) image forming unit 11Y, a magenta (M) image forming unit 11M, a cyan (C) image forming unit 11C and a black (K) image forming unit 11K. Each image forming unit 11 includes a photoconductive drum 12, a charging device 13, an exposure device 14 and a developing device 15. On the photoconductive drum 12, an electrostatic latent image is formed and thus a toner image is formed. The charging device 13 uniformly charges the outer surface of the photoconductive drum 12. The exposure device 14 exposes the photoconductive drum 12 charged by the charging device 13. The developing device 15 develops a latent image formed by the exposure device 14. In addition, the image processing system 10 further includes a paper sheet transport belt 21, a drive roll 22, transfer rolls 23 and a fixing device 24. The paper sheet transport belt 21 transports a recording paper sheet so that color toner images respectively formed on the photoconductive drums 12 of the image forming units 11Y, 11M, 11C and 11K are transferred on the recording paper sheet by multilayer transfer. The drive roll 22 drives the paper sheet transport belt 21. Each transfer roll 23 transfers the toner image formed on the corresponding photoconductive drum 12 onto the recording paper sheet. The fixing device 24 fixes the toner image onto the recording paper sheet.

Figure 2:
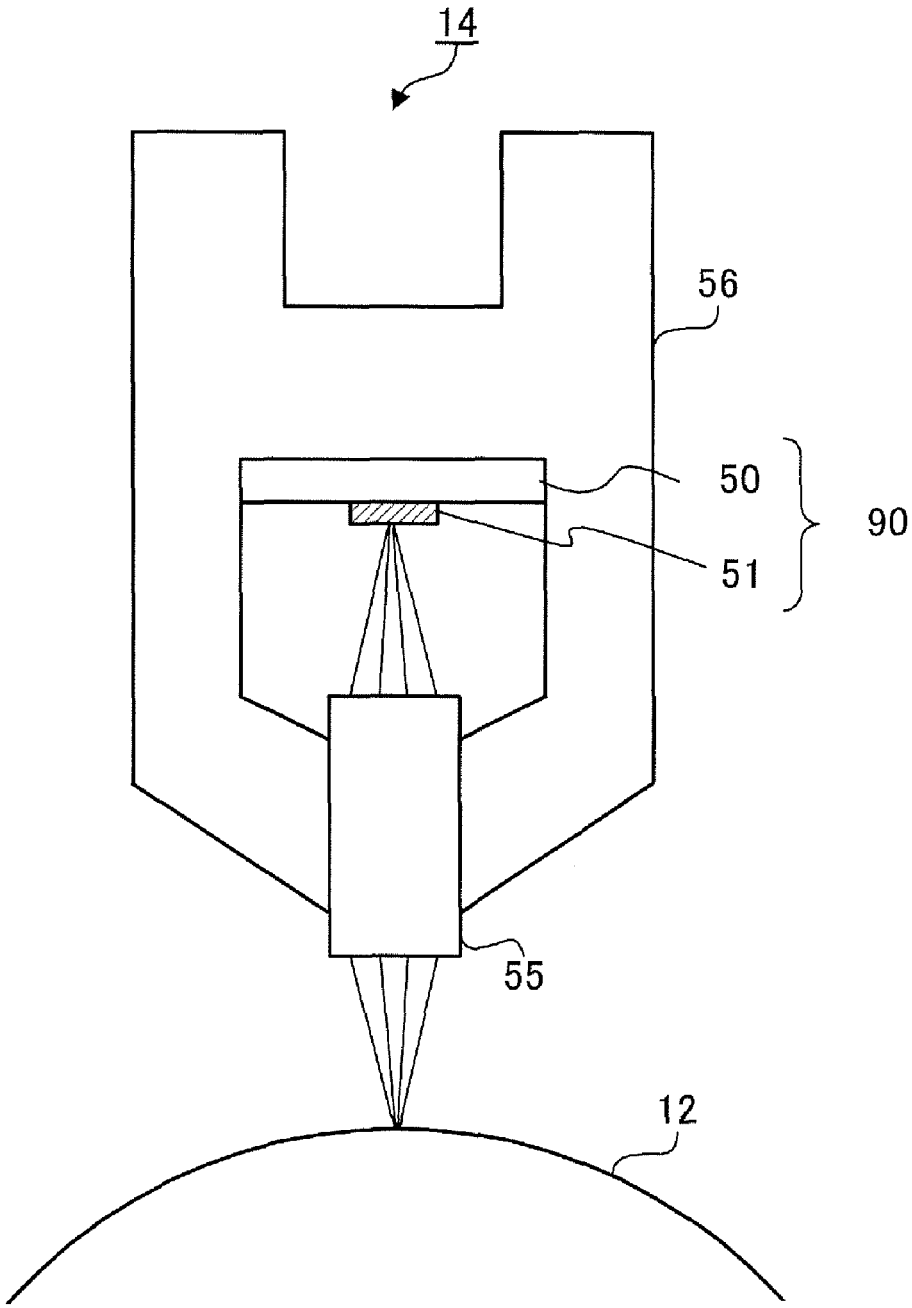
FIG. 2 shows a structure of an exposure device.

FIG. 2 shows a structure of the exposure device 14. The exposure device 14 includes light-emitting element chips 51, a printed circuit board 50 and a rod lens array 55. Each light-emitting element chip 51 is an example of a light-emitting device. The printed circuit board 50 supports the light-emitting element chips 51. In addition, a circuit that performs drive control on the light-emitting element chips 51 is mounted on the printed circuit board 50. The rod lens array 55 focuses an output light emitted from the light-emitting elements onto the photoconductive drum 12. On each light-emitting element chip 51, multiple light-emitting elements are arrayed in a line. The printed circuit board 50 and the rod lens array 55 are held by a housing 56. On the printed circuit board 50, multiple light-emitting element chips 51 are arrayed so that as many light-emitting elements on the light-emitting element chips 51 as the number of pixels are arrayed in the first scan direction. Hereinbelow, the multiple light-emitting element chips 51 and the printed circuit board 50 will be collectively referred to as a light-emitting element head 90.

Figure 3:
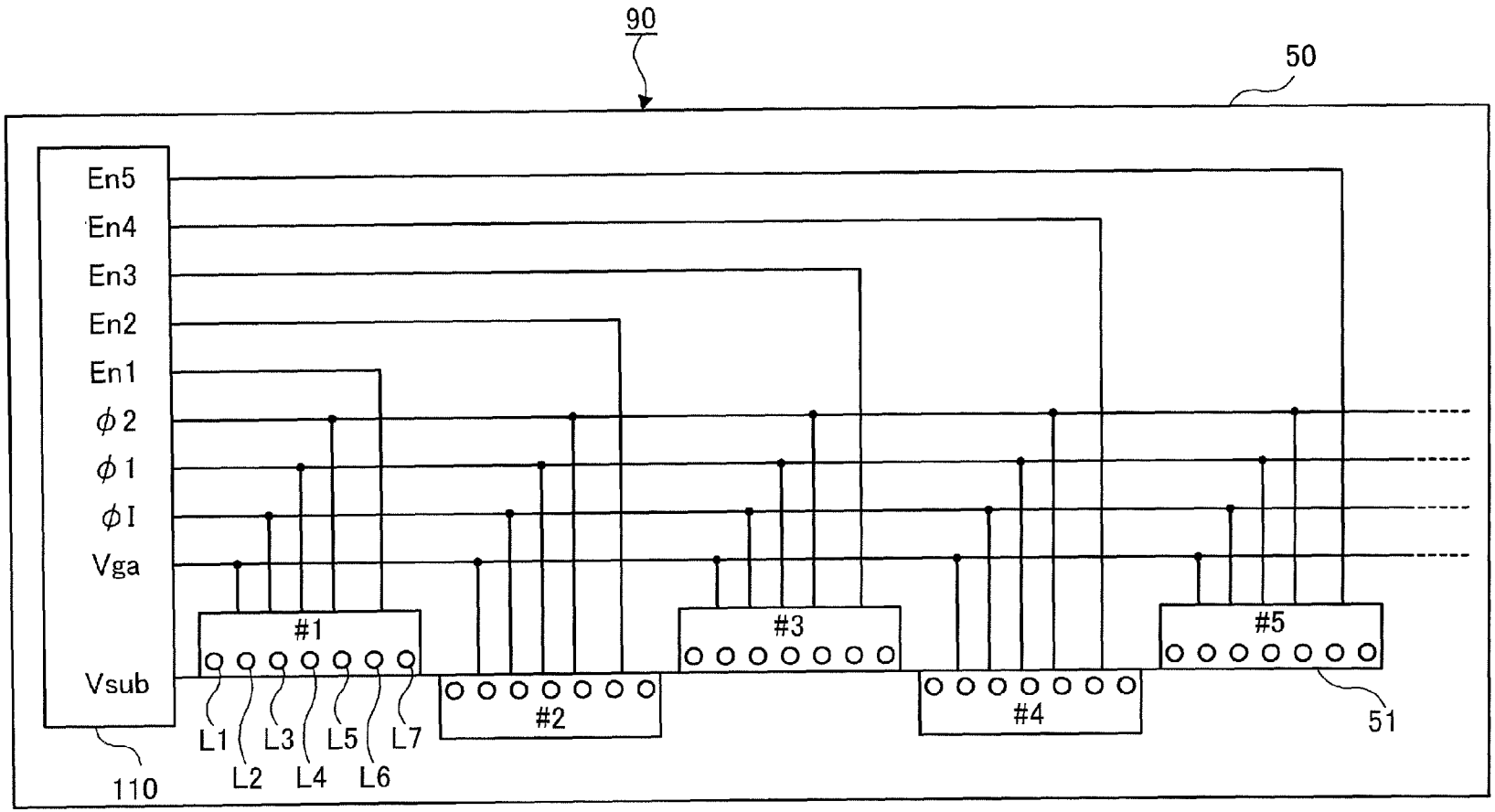
FIG. 3 is a schematic view for explaining a configuration of each light-emitting element head in the first exemplary embodiment.

FIG. 3 is a schematic view for explaining a configuration of each light-emitting element head 90.

The light-emitting element head 90 includes the printed circuit board 50, the multiple light-emitting element chips 51 and a signal generating circuit 110. Each light-emitting element chip 51 includes light-emitting thyristors L1, L2, L3, . . . , which are arrayed in a line, and each of which is an example of a light-emitting element. The signal generating circuit 110 supplies the light-emitting element chips 51 with signals (control signals) for controlling light-emitting operations of the light-emitting thyristors L1, L2, L3, . . . , and thereby controls whether or not the light-emitting thyristors L1, L2, L3, . . . , emit light.

In the light-emitting element head 90, the multiple light-emitting element chips 51 are arrayed in a zigzag pattern on the printed circuit board 50 so that the light-emitting thyristors L1, L2, L3, . . . , on the light-emitting element chips 51 are arrayed in a line at equal intervals. As an example, FIG. 3 shows the case where the light-emitting element head 90 includes five light-emitting element chips 51 (#1 to #5) each including seven light-emitting thyristors L1, L2, L3, . . . arranged thereon. The number of light-emitting element chips 51 and the number of light-emitting thyristors L1, L2, L3, . . . , may each be set to any appropriate number. Note that the light-emitting element chips 51 have the same structure.

From image signals (not shown in the figure) supplied by the image processor 40, and the synchronizing signal and the like (not shown in the figure) supplied by the image output controller 30 in the image forming apparatus 1, the signal generating circuit 110 generates the control signals for controlling the light-emitting operations of the light-emitting thyristors L1, L2, L3, . . . , in the light-emitting element chips 51. Specifically, as the control signals, the signal generating circuit 110 generates a first clock signal $\phi$1, a second clock signal $\phi$2, a lighting signal $\phi$I and light-emission enable signals En. The first clock signal $\phi$1 is a signal for controlling the light-emitting operations of the light-emitting thyristors L1, L2, L3, . . . , in numerical order. The second clock signal $\phi$2 is a signal for setting the light-emitting thyristors L1, L2, L3, . . . , ready to emit light. The lighting signal $\phi$I provides a potential for causing the light-emitting thyristors L1, L2, L3, . . . , to emit light. Each light-emission enable signal En is a signal for controlling whether or not to allow the corresponding light-emitting element chip 51 to emit light.

The signal generating circuit 110 supplies the first and second clock signals $\phi$1 and $\phi$2, and the lighting signal $\phi$I in common to all the light-emitting element chips 51. Meanwhile, the signal generating circuit 110 supplies the mutually different light-emission enable signals En, that is, first to fifth light-emission enable signals En1 to En5, to the respective light-emitting element chips 51. Moreover, the signal generating circuit 110 supplies a power supply voltage Vga and a reference voltage Vsub to all the light-emitting element chips 51.

Figure 4:
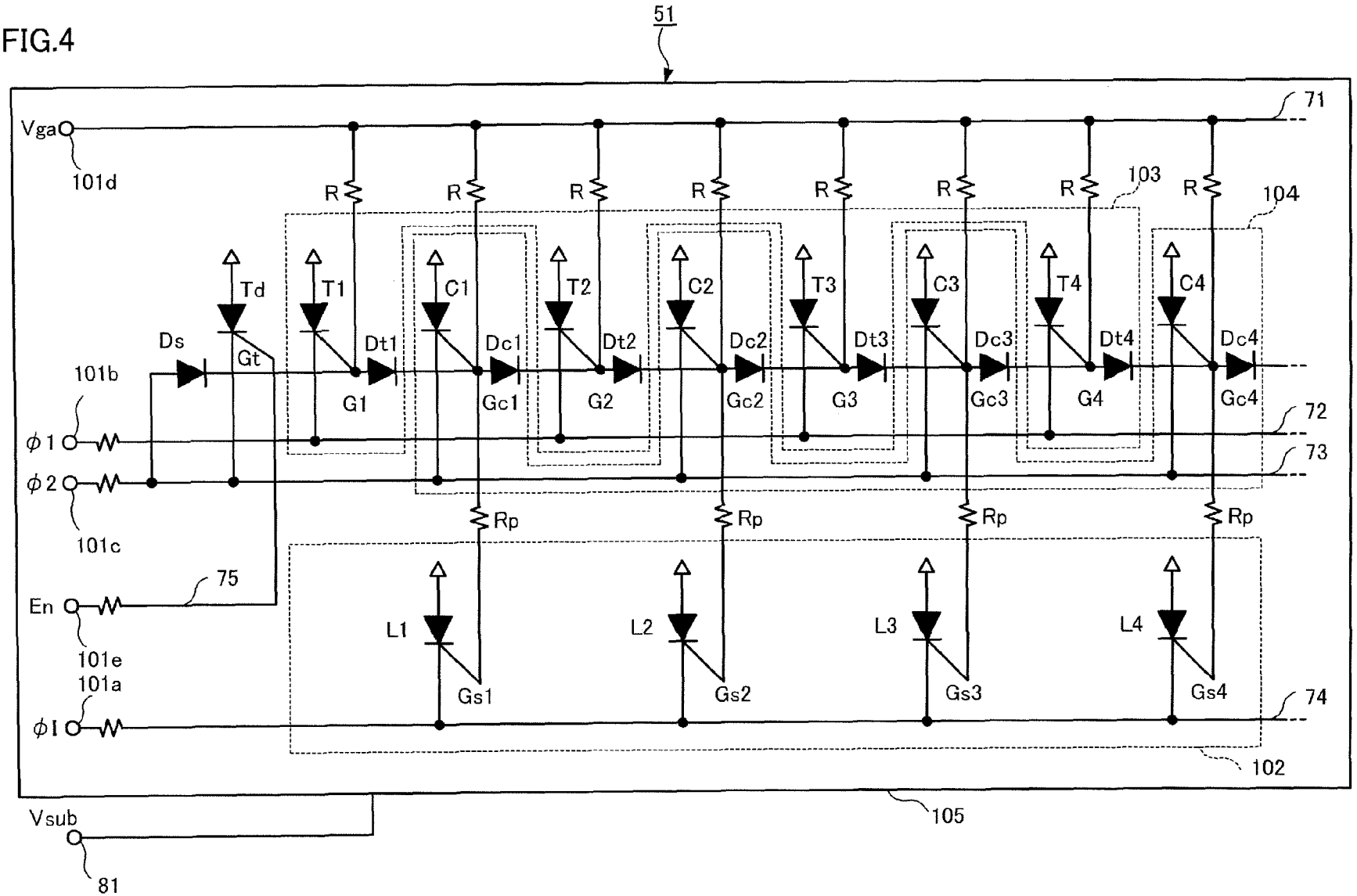
FIG. 4 is a schematic view of an equivalent circuit and a planar layout of each light-emitting element chip in the first exemplary embodiment.

FIG. 4 is a schematic view of an equivalent circuit and a planar layout of each light-emitting element chip 51 in the first exemplary embodiment.

The light-emitting element chip 51 includes: a substrate 105; a light-emitting thyristor array 102 formed of the light-emitting thyristors L1, L2, L3, . . . , arrayed in a line; a transfer thyristor array 103 formed of transfer thyristors T1, T2, T3, . . . , arrayed in a line; and a light-emission control thyristor array 104 formed of light-emission control thyristors C1, C2, C3, . . . , arrayed in a line. In addition, the light-emitting element chip 51 further includes a light-emission enable thyristor Td, a start diode Ds, connecting diodes Dt1, Dt2, Dt3, connecting diodes Dc1, Dc2, Dc3, . . . , and multiple load resistors R. The transfer thyristors T1, T2, T3, . . . , are sequentially turned on to set the light-emission control thyristors C1, C2, C3, . . . to be turned on. Specifically, each transfer thyristor turns on the light-emission control thyristor that is connected thereto and assigned the same number as that of the transfer thyristor. Meanwhile, each of the light-emission control thyristors C1, C2, C3, . . . is turned on when corresponding one of the transfer thyristors T1, T2, T3, . . . that is assigned the same number as that of the light-emission control thyristor is turned on. When turned on, each of the light-emission control thyristors C1, C2, C3, . . . specifies corresponding one of the light-emitting thyristors L1, L2, L3, . . . that is assigned the same number as that of the light-emission control thyristor as a target for controlling whether or not to emit light, and sets the light-emitting thyristor ready to emit light. In addition, the light-emission enable thyristor Td is connected in parallel to the light-emission control thyristors C1, C2, C3, . . . , and, when turned on, the light-emission enable thyristor Td prevents the light-emission control thyristors C1, C2, C3, . . . from transitioning from an off state to an on state. On the other hand, when turned off, the light-emission enable thyristor Td allows the light-emission control thyristors C1, C2, C3, . . . to transition from the off state to the on state. In other words, the light-emission enable thyristor Td controls whether or not to allow any of the light-emitting thyristors L1, L2, L3, . . . , that is set ready to emit light to actually emit light.

The light-emitting thyristors L1, L2, L3, . . . , the transfer thyristors T1, T2, T3, . . . , the light-emission control thyristors C1, C2, C3, . . . , and the light-emission enable thyristor Td, which have a pnpn structure formed of a GaAs-based semiconductor, each are a three-terminal thyristor having an anode electrode, a cathode electrode and a gate electrode.

Note that each of the light-emitting thyristors L1, L2, L3, . . . starts emitting light upon transitioning from the off state to the on state. Here, the light-emitting thyristor conducts between the anode electrode and the cathode electrode when turned on, while does not conduct when turned off.

Hereinbelow, the i-th light-emitting thyristor from the left of FIG. 4 (from the side closer to terminals 101*a* to 101*e* to be described later) will be expressed as a light-emitting thyristor Li (i is an integer of 1 or more). Additionally, the transfer thyristors, the light-emission control thyristors and the connecting diodes will be represented in a similar manner.

As shown in FIG. 4, in the light-emitting element chip 51 in the first exemplary embodiment, the transfer thyristors Ti and the light-emission control thyristors Ci are alternately arrayed in a line. Meanwhile, the light-emitting thyristors Li are arrayed in a line and connected to the respective light-emission control thyristors Ci. Here, the number of light-emitting thyristors Li, the number of transfer thyristors Ti and the number of light-emission control thyristors Ci are the same as one another in the light-emitting element chip 51.

Next, a description will be given of the connection relation and the positional relation of the elements with reference to FIG. 4.

The gate electrode Gi of each transfer thyristor Ti is connected to the gate electrode Gci of the light-emission control thyristor Ci adjacent to the transfer thyristor Ti via the corresponding connecting diode Dti. Here, each connecting diode Dti is connected with its orientation set to allow a current to flow from the gate electrode Gi to the gate electrode Gci.

The gate electrode Gci of each light-emission control thyristor Ci is connected to the gate electrode Gi+1 of the transfer thyristor Ti+1 adjacent to the light-emission control thyristor Ci via the corresponding connecting diode Dci. Here, each connecting diode Dci is connected with its orientation set to allow a current to flow from the gate electrode Gci to the gate electrode Gi+1. In this way, in the light-emitting element chip 51, the connecting diodes Dti and the connecting diodes Dci are alternately arrayed so as to allow a current to flow in one direction therethrough. In addition, the gate electrode Gci of each light-emission control thyristor Ci is connected to the gate electrode Gsi of the corresponding light-emitting thyristor Li via a resistor Rp. Note that each resistor Rp is a parasitic resistance attributable to wiring and the like.

The gate electrode Gi of each transfer thyristor Ti and the gate electrode Gci of each light-emission control thyristor Ci are connected to a power supply line 71 via the respective load resistors R provided corresponding to these thyristors. The cathode electrode of each transfer thyristor Ti is connected to a first clock signal line 72. The cathode electrode of each light-emission control thyristor Ci is connected to a second clock signal line 73. The cathode electrode of each light-emitting thyristor Li is connected to a lighting signal line 74.

The cathode electrode and the gate electrode Gt of the light-emission enable thyristor Td are connected to the second clock signal line 73 and a light-emission enable signal line 75, respectively.

The anode electrode of each of the transfer thyristors Ti, the light-emission control thyristors Ci, the light-emitting thyristors Li and the light-emission enable thyristor Td is connected to a backside common electrode 81 of the substrate 105.

Note that the cathode terminal and the anode terminal of the start diode Ds is connected to the gate electrode G1 of the transfer thyristor T1 and the second clock signal line 73, respectively.

The lighting signal line 74, the first clock signal line 72, the second clock signal line 73 and the light-emission enable signal line 75 are connected to a lighting signal terminal 101*a*, a first clock signal terminal 101*b*, a second clock signal terminal 101*c* and a light-emission enable signal terminal 101*e*, via resistors, respectively. The power supply line 71 is connected to a power supply terminal 101*d*.

Thus, in terms of connection relations respectively of the anode electrode and the cathode electrode, it may be said that the light-emission enable thyristor Td is connected in parallel to the light-emission control thyristors Ci. In this regard, the cathode electrode of the light-emission enable thyristor Td is connected to the second clock signal line 73 at a position closer to the second clock signal terminal 101*c* than any of the light-emission control thyristors Ci is.

The lighting signal terminal 101*a*, the first clock signal terminal 101*b*, the second clock signal terminal 101*c* and the light-emission enable signal terminal 101*e* are supplied with the lighting signal ϕI, the first clock signal ϕ1, the second clock signal ϕ2 and one of the light-emission enable signals En, respectively.

Meanwhile, the power supply terminal 101*d* and the backside common electrode 81 are supplied with the power supply voltage Vga (assumed here to be −3.3 V), and the reference voltage Vsub (assumed here to be 0 V), respectively.

Figure 5:
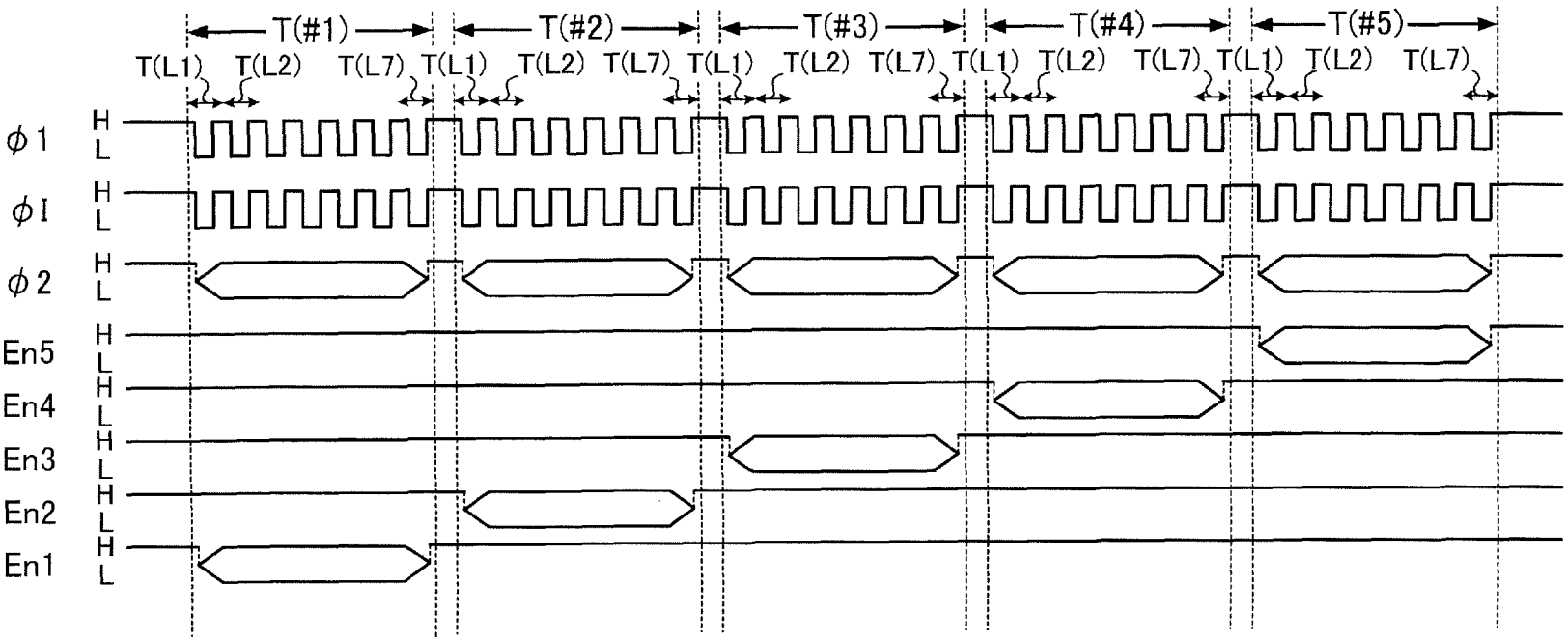
FIG. 5 is a time chart for explaining a first driving method of driving each light-emitting element head in the first exemplary embodiment.

FIG. 5 is a time chart for explaining a first driving method of driving each light-emitting element head 90 in the first exemplary embodiment.

In the first driving method, drive control of #1 to #5 of the light-emitting element chips 51 are performed in numerical order. In response, in each of #1 to #5 of the light-emitting element chips 51, light-emitting operations of the light-emitting thyristors L1 to L7 provided therein are controlled in numerical order. Note that, in the following description, periods during which drive control of #1 to #5 of the light-emitting element chips 51 is performed will be referred to as periods T(#1) to T(#5), respectively. In addition, in each of the periods T(#1) to T(#5), periods during which the light-emitting operations of the light-emitting thyristors L1 to L7 in the corresponding light-emitting element chip 51 are controlled will be referred to as periods T(L1) to T(L7), respectively.

In the initial state, all the light-emitting thyristors Li of #1 to #5 of the light-emitting element chips 51 are turned off.

The signal generating circuit 110 outputs the first clock signal ϕ1 that repeats a pair of a transition from an H level to a L level and a transition from the L level to the H level the same number of times as the number of the light-emitting thyristors Li in the light-emitting element chip 51 (seven times) in each of the periods T(#1) to T(#5). Note that each of the foregoing periods T(L1) to T(L7) is nearly equivalent to a period from when the first clock signal ϕ1 is caused to transition from the H level to the L level to when the first clock signal ϕ1 is then caused to transition from the H level to the L level.

In addition, the signal generating circuit 110, as an example of a setting unit, also outputs the lighting signal ϕI that repeats a pair of a transition from the H level to the L level and a transition from the L level to the H level the same number of times as the number of the light-emitting thyristors Li (seven times) in each of the periods T(#1) to T(#5). Note that, as will be described later, in each of the periods T(L1) to T(L5), the lighting signal ϕI transitions from the H level to the L level after the first clock signal ϕ1 transitions from the H level to the L level, and the lighting signal ϕI transitions from the L level to the H level before the first clock signal ϕ1 transitions from the L level to the H level.

Hereinbelow, a potential difference between the anode electrode and the cathode electrode of each light-emitting thyristor Li when the lighting signal ϕI is at the H level will be referred to as a first potential difference, while a potential difference between the anode electrode and the cathode electrode of the light-emitting thyristor Li when the lighting signal ϕI is at the L level will be referred to as a second potential difference.

The signal generating circuit 110, as an example of a supply unit, also outputs the second clock signal ϕ2 that repeats transitions between the H level and the L level in each of the periods T(#1) to T(#5).

Additionally, the signal generating circuit 110 also outputs the first to fifth light-emission enable signals En1 to En5. The first light-emission enable signal En1 transitions between the H level and the L level as necessary in the period T(#1), but the first light-emission enable signal En1 is fixed at the H level in the other periods T(#2) to T(#5). The second light-emission enable signal En2 transitions between the H level and the L level as necessary in the period T(#2), but the second light-emission enable signal En2 is fixed at the H level in the other periods T(#1) and T(#3) to T(#5). The third light-emission enable signal En3 transitions between the H level and the L level as necessary in the period T(#3), but the third light-emission enable signal En3 is fixed at the H level in the other periods T(#1), T(#2), T(#4) and T(#5). The fourth light-emission enable signal En4 transitions between the H level and the L level as necessary in the period T(#4), but the fourth light-emission enable signal En4 is fixed at the H level in the other periods T(#1) to T(#3) and T(#5). The fifth light-emission enable signal En5 transitions between the H level and the L level as necessary in the period T(#5), but the fifth light-emission enable signal En5 is fixed at the H level in the other periods T(#1) to T(#4).

For example, in the period T(#1), the light-emitting operations of the light-emitting thyristors Li provided in #1 of the light-emitting element chips 51 are controlled by using the first and second clock signals ϕ1 and ϕ2, the lighting signal ϕ1 and the first light-emission enable signal En1. Here, the first and second clock signals ϕ1 and ϕ2, and the lighting signal ϕI are supplied in common to #1 to #5 of the light-emitting element chips 51, while the first light-emission enable signal En1 is supplied only to #1 of the light-emitting element chips 51. At this time, the light-emitting operation of the light-emitting thyristor L1 is controlled in the period T(L1) of the period T(#1), and the light-emitting operation of the light-emitting thyristor L7 is controlled in the period T(L7) of the period T(#1), for example. Note that #2 to #5 of the light-emitting element chips 51 are controlled in a similar manner in the periods T(#2) to T(#5), respectively. Specifically, in each of the periods T(#2) to T(#5), the light-emitting operations of the light-emitting thyristors Li provided in the corresponding one of #2 to #5 of the light-emitting element chips 51 are controlled by using the first and second clock signals ϕ1 and ϕ2, the lighting signal ϕI and the corresponding one of the second to fifth light-emission enable signals En2 to En5. Here, the first and second clock signals ϕ1 and ϕ2, the lighting signal ϕI are supplied in common to all the light-emitting element chips 51, while the second to fifth light-emission enable signals En2 to En5 are supplied respectively to #2 to #5 of the light-emitting element chips 51.

Figure 6:
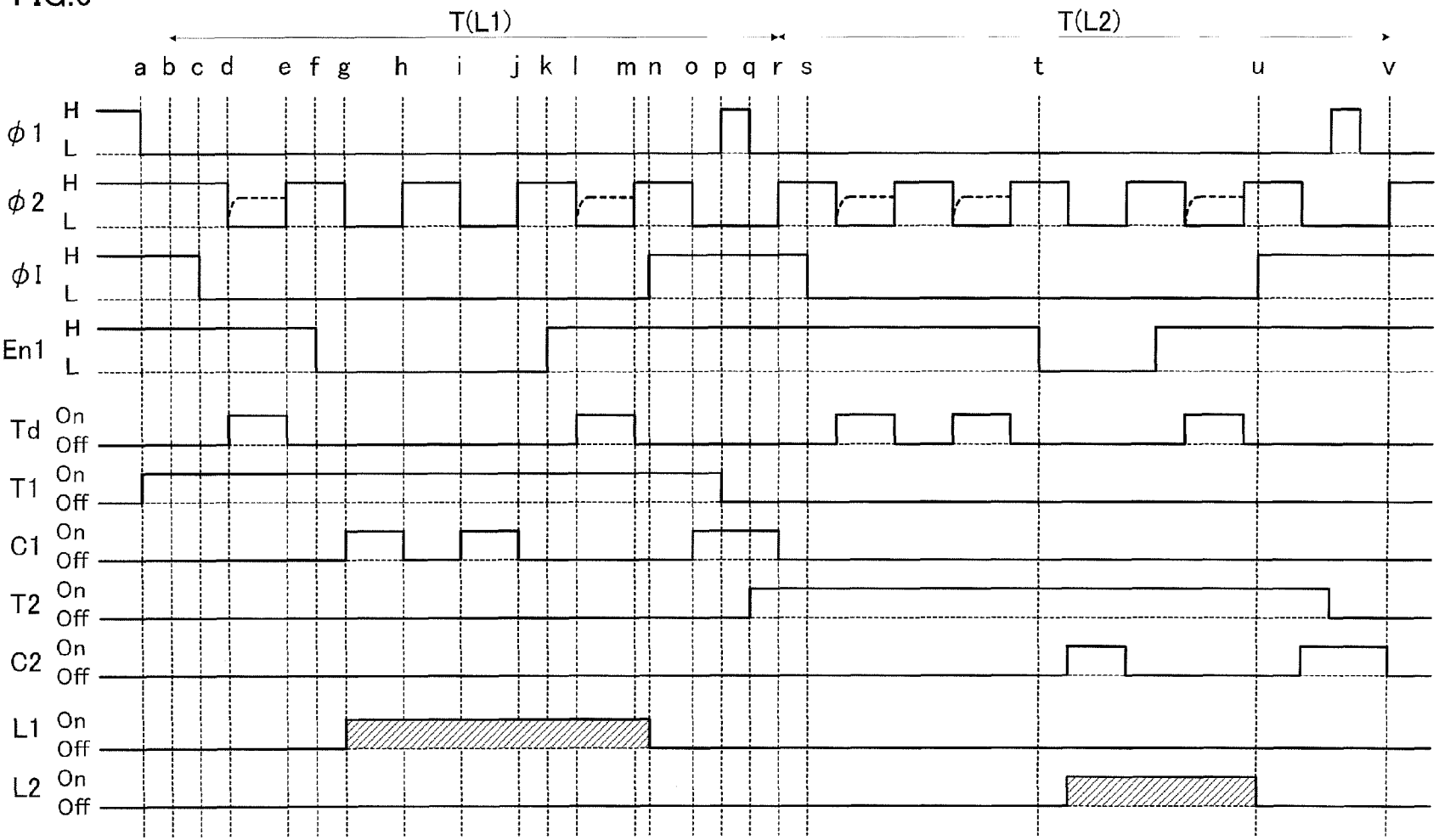
FIG. 6 is a time chart for explaining operations of the light-emitting element chips in the first driving method.

FIG. 6 is a time chart for explaining operations of the light-emitting element chips 51 in the first driving method shown in FIG. 5. Here, a description will be given of an operation of one of the light-emitting element chips 51 alone, by using, as an example, #1 of the light-emitting element chips 51 whose drive control is performed in the period T(#1). Thus, in this example, among the light-emission enable signals En, the first light-emission enable signal En1 is supplied to the light-emitting element chip 51. Specifically, FIG. 6 illustrates light-emission control of the two light-emitting thyristors L1 and L2 among the seven light-emitting thyristors L1 to L7 provided in #1 of the light-emitting element chips 51. Note that, in this example, a period from a time point b to a time point r and a period from the time point r to a time point v are the periods T(L1) and T(L2), respectively.

In the period T(L1), the first clock signal ϕ1 is at the L level during a period from the time point b to a time point p, at the H level during a period from the time point p to a time point q, and at the L level during a period from the time point q to the time point r. In the period T(L1), the second clock signal ϕ2 cyclically repeats transitions between the H level and the L level multiple times in the period from the time point b to the time point p. Meanwhile, in the period T(L1), the lighting signal ϕI is at the L level during a period from a time point c to a time point n, and at the H level during the other periods. Here, the time point c comes after the time point b while the time point n comes before the time point p. Accordingly, the lighting signal ϕI becomes the L level after the first clock signal ϕ1 transitions to the L level, and becomes the H level before the first clock signal ϕ1 transitions to the H level. Each of the first and second clock signals ϕ1 and ϕ2, and the lighting signal ϕI repeats the cycle of the period T(Li).

In the initial state (just before a time point a), the transfer thyristors Ti, the light-emission control thyristors Ci, the light-emitting thyristors Li and the light-emission enable thyristor Td are all turned off. In this state, the first and second clock signals ϕ1 and ϕ2 and the lighting signal ϕI are set to the H level, that is, to the reference voltage Vsub=0 V, for example. In addition, the first light-emission enable signal En1 is also set to the H level.

Note that, when the lighting signal ϕI is at the H level, the anode electrode and the cathode electrode of each light-emitting thyristor Li are both at the H level, and thus have approximately the same potential as each other, so that the first potential difference, which is a potential difference between the anode electrode and the cathode electrode of the light-emitting thyristor Li, is 0 V.

In that initial state, the start diode Ds is forward biased, and thus the potential of the gate electrode G1 of the transfer thyristor T1 takes a value obtained by subtracting, from the H level (0 V), a forward threshold voltage (diffusion potential) Vd of the pn junction of the start diode Ds. Thus, in the initial state, the potential of the gate electrode G1 of the transfer thyristor T1 is −1.4 V since the forward threshold voltage Vd of the pn junction may be considered to be 1.4 V on the basis of the properties of the light-emitting element chip 51.

In general, the potential difference between the anode electrode and the cathode electrode of a thyristor for turning on the thyristor (the potential difference will be hereinafter referred to as ON voltage Von) is expressed by Von<Vg−Vd, where Vg denotes the potential of the gate electrode of the thyristor. Since Vd denotes the forward threshold voltage of the pn junction, the ON voltage Von of the transfer thyristor T1 is −2Vd=−2.8 V.

Meanwhile, in the initial state, the potential of the gate electrode Gc1 of the light-emission control thyristor C1, which is adjacent to the transfer thyristor T1, depends on the forward threshold voltage Vd of the pn junctions respectively in the start diode Ds and the connecting diode Dt1, and thus is −2Vd=−2.8 V. In the initial state, the ON voltage Von of the light-emission control thyristor C1 is −4.2 V. The potential of the gate electrodes G2, G3, . . . , and Gc2, Gc3, . . . , respectively of the transfer thyristors T2, T3, . . . , and the light-emission control thyristors C2, C3, . . . , is the power supply voltage Vga=−3.3 V, and thus the ON voltage Von of these thyristors is −4.7 V in the initial state.

In the initial state, the potential of the gate electrode Gsi of each light-emitting thyristor Li is the power supply voltage Vga=−3.3 V, and thus the ON voltage Von of all the light-emitting thyristors Li is −4.7 V.

On the other hand, in the initial state, the potential of the gate electrode Gt of the light-emission enable thyristor Td is 0 V since the first light-emission enable signal En1 is set to the H level. Accordingly, in the initial state, the ON voltage Von of the light-emission enable thyristor Td is −1.4 V.

At the time point a shown in FIG. 6, the voltage of the first clock signal ϕ1 drops to a voltage, such as the power supply voltage Vga=−3.3 V (L level), lower than the ON voltage Von (−2.8 V) of the transfer thyristor T1 but higher than the ON voltage Von (−4.7 V) of the other transfer thyristors T2, T3, . . . . In response, among the transfer thyristors, only the transfer thyristor T1 gets turned on, and thereby the transfer operation of the transfer thyristor array 103 starts.

Note that it is only in the initial state where the light-emitting element chip 51 starts operating that the both the first and second clock signals ϕ1 and ϕ2 are at the H level, and thus the start diode Ds operates only in the initial state.

When the transfer thyristor T1 gets turned on, the potential of the gate electrode G1 rises from −1.4 V to approximately the H level of 0 V. The effect of this potential rise is transmitted to the gate electrode Gc1 through the connecting diode Dt1 that gets forward biased. In response, the potential of the gate electrode Gc1 rises from −2.8 V to −1.4 V, and thus the ON voltage Von of the light-emission control thyristor C1 rises from −4.2 V to −2.8 V.

This further causes the potential of the gate electrode G2 of the transfer thyristor T2 to rise from −3.3 V to −2.8 V, and thus the ON voltage Von of the transfer thyristor T2 rises from −4.7 V to −4.2 V. Meanwhile, the potential of the gate electrodes Gc2, Gc3, . . . , and G3, G4, . . . , respectively of the light-emission control thyristors C2, C3, . . . , and the transfer thyristors T3, T4, . . . , remains at the power supply voltage Vga=−3.3 V, and thus the ON voltage Von of these thyristors remains at −4.7 V.

The potential of the gate electrode Gs1 of the light-emitting thyristor L1 becomes a voltage based on both the forward threshold voltage Vd of the pn junction in the connecting diode Dt1 and a voltage drop (δ) caused by the corresponding resistor Rp, that is, becomes −Vd+δ. Accordingly, the potential of the gate electrode Gs1 of the light-emitting thyristor L1 rises from −3.2 V to −2.2 V, and thus the ON voltage Von of the light-emitting thyristor L1 rises from −4.7 V to −3.6 V if δ is set to be −0.8 V on the basis of the properties of the light-emitting element chip 51.

Meanwhile, the potential of the gate electrodes Gs2, Gs3, . . . of the light-emitting thyristors L2, L3, . . . remains at the power supply voltage Vga=−3.3 V, and thus the ON voltage Von of these light-emitting thyristors remains at −4.7 V.

At the time point c, that is, after the transfer thyristor T1 gets turned on at the time point a, the lighting signal ϕI transitions from the H level to the L level (−3.3 V). In response, in each light-emitting thyristor Li forming the light-emitting thyristor array 102, the potential of the cathode electrode becomes lower than that of the anode electrode, namely, becomes −3.3 V. However, none of the light-emitting thyristors Li is turned on to emit light since the ON voltage Von of the light-emitting thyristor L1 is −3.6 V, and the ON voltage Von of the light-emitting thyristors L2, L3, . . . , is −4.7 V.

Note that, when the lighting signal ϕI is at the L level, the potential of the anode electrode of each light-emitting thyristor Li is at the H level (0 V) while the potential of the cathode electrode thereof is at the L level (−3.3 V), so that the second potential difference, which is a potential difference between the anode electrode and the cathode electrode of the light-emitting thyristor Li, is −3.3 V.

Then, at a time point d, the voltage of the second clock signal ϕ2 is caused to transition to a voltage, such as the power supply voltage Vga=−3.3 V (L level), lower than the ON voltage Von (−2.8 V) of the light-emission control thyristor C1 but higher than the ON voltage Von (−4.7 V) of the other light-emission control thyristors C2, C3, . . . . In response, the light-emission enable thyristor Td, which is connected in parallel to the light-emission control thyristors Ci, is turned on since the ON voltage Von of the light-emission enable thyristor Td is −1.4 V. Thereby, the potential of the cathode electrode of the light-emission enable thyristor Td drops from 0 V to −1.4 V which is the forward threshold voltage Vd of the pn junction. This causes the potential of the second clock signal line 73 to which the cathode electrode of the light-emission enable thyristor Td is connected to immediately rise from −3.3 V to −1.4 V and be fixed at −1.4 V (this state is expressed by the dashed line drawn in a period from the time point d to a time point e in FIG. 6).

It might be considered that, at the time point d, when the second clock signal ϕ2 transitions to the L level (−3.3 V), the light-emission control thyristor C1 gets turned on since the ON voltage Von of the light-emission control thyristor C1 is −2.8 V as described above. However, as shown in FIG. 4, the light-emission enable thyristor Td is connected to the second clock signal line 73 at a point closer to the second clock signal terminal 101*c* than any of the light-emission control thyristors Ci including the light-emission control thyristor C1 is. In addition, at the time point d, the ON voltage Von of the light-emission enable thyristor Td is −1.4 V, whose absolute value is smaller than that of the ON voltage Von (−2.8 V) of the light-emission control thyristor C1, as described above. Accordingly, the condition that the second clock signal ϕ2 reaches the light-emission enable thyristor Td before reaching to the light-emission control thyristor C1 and the condition that the absolute value of the ON voltage Von of the light-emission enable thyristor Td is smaller than that of the light-emission control thyristor C1 combine to turn on the light-emission enable thyristor Td. This causes the potential of the cathode electrode of the light-emission enable thyristor Td to drop from 0 V to −1.4 V which is the forward threshold voltage Vd of the pn junction, and thus fixes the potential of the second clock signal line 73 at −1.4 V. Consequently, the light-emission control thyristor C1 is not allowed to be turned on, and thus remains turned off.

Accordingly, at the time point d, no change occurs in the ON voltage Von of any of the light-emitting thyristors Li, which thus emits no light.

Then, at the time point e, the second clock signal ϕ2 transitions to the H level. This causes the cathode electrode and the anode electrode of the light-emission enable thyristor Td to have approximately the same potential as each other. As a result, the light-emission enable thyristor Td is no longer kept turned on, and thus gets turned off. Note that, at the time point e, the light-emission control thyristor C1 is kept turned off since the second clock signal ϕ2 is at the H level.

Subsequently, at a time point f, the first light-emission enable signal En1 is set to the L level of −3.3 V. In response, the ON voltage Von of the light-emission enable thyristor Td drops from −1.4 V to −4.7 V.

Then, at a time point g, the second clock signal ϕ2 transitions to the L level. At this time, the light-emission enable thyristor Td is not allowed to be turned on since its ON voltage Von is −4.7 V. Thus, the potential of the second clock signal line 73 changes in accordance with the second clock signal ϕ2, thus becoming the L level of −3.3 V, which is lower than the ON voltage Von (−2.8 V) of the light-emission control thyristor C1 but higher than the ON voltage Von (−4.7 V) of the other light-emission control thyristors C2, C3, . . . . As a result, the light-emission control thyristor C1 gets turned on at the time point g.

When the light-emission control thyristor C1 is turned on, the potential of the gate electrode Gc1 rises to approximately the H level of 0 V. In response, the potential of the gate electrode Gs1 of the light-emitting thyristor L1 becomes −0.8 V, and thus the ON voltage Von of the light-emitting thyristor L1 rises from −3.6 V to −2.2 V. Meanwhile, the potential of the gate electrodes Gs2, Gs3, . . . , remains at the power supply voltage Vga=−3.3 V, and thus the ON voltage Von of the light-emitting thyristors L2, L3, . . . , remains at −4.7 V. In addition, at the time point g, the lighting signal ϕI remains at the L level of −3.3 V. Thus, among the light-emitting thyristors Li of the light-emitting thyristor array 102, only the light-emitting thyristor L1 gets turned on, and thus starts emitting light since the potential difference between the anode electrode and the cathode electrode of the light-emitting thyristor L1 alone becomes lower than the ON voltage Von thereof.

Hereinbelow, the potential of the gate electrode Gsi of each light-emitting thyristor Li when the potential difference between the anode electrode and the cathode electrode of the light-emitting thyristor Li becomes lower than the ON voltage Von will be referred to as transition voltage. In other words, when the transition voltage is applied to the gate electrode Gsi of the light-emitting thyristor Li, the light-emitting thyristor Li transitions from the off state to the on state. Meanwhile, the potential of the gate electrode Gsi of the light-emitting thyristor Li when the potential difference between the anode electrode and the cathode electrode of the light-emitting thyristor Li is not lower than the ON voltage Von will be referred to as maintaining voltage. Thus, even if the maintaining voltage is applied to the gate electrode Gsi of the light-emitting thyristor Li, the light-emitting thyristor Li remains turned off.

Here, the potential of the gate electrode Gs1 that sets the ON voltage Von of the light-emitting thyristor L1 to −2.2 V is −0.8 V, which serves as the transition voltage. Meanwhile, the potential of the gate electrode Gs1 that sets the ON voltage Von of the light-emitting thyristor L1 to a voltage lower than −3.3 V serves as the maintaining voltage. For example, the maintaining voltage may be −2.2 V, which is based on both the forward threshold voltage Vd of the pn junction in the connecting diode Dt1 and the voltage drop δ caused by the corresponding resistor Rp, or may be the power supply voltage Vga=−3.3 V.

Additionally, when the potential of the gate electrode Gc1 rises to approximately the H level of 0 V, the effect of this potential rise is transmitted to the gate electrode G2 through the connecting diode Dc1 that gets forward biased. In response, the potential of the gate electrode G2 rises from −2.8 V to −1.4 V, and thus the ON voltage Von of the transfer thyristor T2 rises from −4.2 V to −2.8 V.

Then, at a time point h, the second clock signal ϕ2 transitions to the H level. This causes the cathode electrode and the anode electrode of the light-emission control thyristor C1 to have approximately the same potential as each other. As a result, the light-emission control thyristor C1 gets turned off, and thus the potential of the gate electrode Gc1 drops back from 0 V to −1.4 V. This further causes the ON voltage Von of the transfer thyristor T2 to drop back from −2.8 V to −4.2 V.

However, the lighting signal ϕI set to the L level keeps the light-emitting thyristor L1 turned on. In other words, even if the light-emission control thyristor C1 gets turned off at the time point h, the light-emitting thyristor L1 is kept turned on, and thus continues to emit light.

Subsequently, at a time point i, the second clock signal ϕ2 transitions to the L level. In response, the light-emission control thyristor C1 gets turned on again. Then, at a time point j, the second clock signal ϕ2 transitions to the H level. In response, the light-emission control thyristor C1 gets turned off again.

At these time points, the light-emitting thyristor L1 continues to emit light since the lighting signal ϕI still keeps the light-emitting thyristor L1 turned on, as described above.

Then, at a time point k, the first light-emission enable signal En1 transitions to the H level. In response, the potential of the gate electrode Gt rises from −3.3 V to 0 V, and thus the ON voltage Von of the light-emission enable thyristor Td rises from −4.7 V to −1.4 V.

Subsequently, at a time point 1, the second clock signal ϕ2 transitions to the L level. This turns on not the light-emission control thyristor C1 but the light-emission enable thyristor Td whose ON voltage Von is −1.4 V, so that the light-emission enable thyristor Td immediately raises and fixes the potential of the second clock signal line 73 at −1.4 V (this state is expressed by the dashed line drawn in a period from the time point 1 to a time point m in FIG. 6).

Then, at the time point m, the second clock signal ϕ2 transitions to the H level, and thus the light-emission enable thyristor Td gets turned off.

However, at the time points l and m, the light-emitting thyristor L1 still continues to emit light since the lighting signal ϕI keeps the light-emitting thyristor L1 turned on.

Then, at the time point n, the lighting signal ϕI transitions from the L level to the H level. This causes the cathode electrode and the anode electrode of the light-emitting thyristor L1 to have approximately the same potential as each other. As a result, the light-emitting thyristor L1 is no longer kept turned on, and gets turned off. Thus, the light-emitting thyristor L1 stops emitting light.

Here, in order to control whether or not the light-emitting thyristors L1, L2, L3, . . . , emit light in numerical order in each light-emitting element chip 51, the following periods need to be repeated: a period during which the transfer thyristor Ti alone is turned on; a period during which the transfer thyristor Ti and the light-emission control thyristor Ci adjacent thereto are both turned on; a period during which the light-emission control thyristor Ci alone is turned on; a period during which the light-emission control thyristor Ci and the transfer thyristor Ti+1 adjacent thereto are both turned on; and a period during which the transfer thyristor Ti+1 alone is turned on.

However, at the time point n, the transfer thyristor T1 is turned on, but the light-emission control thyristor C1 is turned off. Thus, at a time point o, immediately after the time point n, the second clock signal ϕ2 is set to the L level, and thus the light-emission control thyristor C1 gets turned on again. As a result, the transfer thyristor T1 and the light-emission control thyristor C1 are both turned on. In response, the potential of the gate electrode G2 rises from −2.8 V to −1.4 V, and thus the ON voltage Von of the transfer thyristor T2 rises from −4.2 V to −2.8 V.

Thereafter, at the time point p, the first clock signal ϕ1 transitions to the H level, and thus the transfer thyristor T1 gets turned off. Meanwhile, the light-emission control thyristor C1 is kept turned on.

Then, at the time point q, the first clock signal ϕ1 transitions to the L level, and thus the transfer thyristor T2 gets turned on. As a result, the light-emission control thyristor C1 and the transfer thyristor T2 both get turned on.

After that, at the time point r, the second clock signal ϕ2 transitions to the H level, and thus the light-emission control thyristor C1 gets turned off. Meanwhile the transfer thyristor T2 is kept turned on.

Note that, during a period from the time point o to the time point r, the lighting signal ϕI is at the H level, so that none of the light-emitting thyristors Li emits light.

As has been described above, the period from the time point o to the time point r serves as a transition period from the period during which the transfer thyristor T1 is turned on to the period during which the transfer thyristor T2 is turned on.

In other words, at the time point r, the period T(L1) for controlling the light-emitting operation of the light-emitting thyristor L1 ends and the period T(L2) for controlling the light-emitting operation of the light-emitting thyristor L2 starts. The subsequent process, which will not be specifically described here, may be achieved simply by repeating the operations performed at and after the time point b.

Note that, in the period T(L2), even if the transfer thyristor T2 is turned on, so that the potential of the gate electrode G2 rises to approximately the H level of 0 V, the effect of this electronic potential rise is not transmitted to the gate electrode G1 since the connecting diodes Dc1 and Dt1 are both reverse biased in this period. Accordingly, during the period T(L2), the potential of the gate electrode G1 is the power supply voltage Vga=−3.3 V, and thus the ON voltage Von of the transfer thyristor T1 is −4.7 V. For this reason, though the first clock signal ϕ1 transitions to the L level (−3.3 V) at the time point q, the transfer thyristor T1 does not get turned on any more.

In other words, in each period T(Li), it is only the corresponding one of the transfer thyristors Ti that is allowed to be turned on in the transfer thyristor array 103.

Similarly, during the period T(L2), since the connecting diode Dc1 is kept reverse biased, the potential of the gate electrode Gc1 of the light-emission control thyristor C1 is the power supply voltage Vga=−3.3 V, and thus the ON voltage Von of the light-emission control thyristor C1 is −4.7V. For this reason, in the period T(L2), the light-emission control thyristor C1 is not allowed to be turned on even if the second clock signal ϕ2 transitions to the L level (−3.3 V).

In other words, in the period T(Li), it is only the corresponding one of the light-emission control thyristors Ci that is allowed to be turned on in the light-emission control thyristor array 104.

Meanwhile, during the period T(L2), since the connecting diode Dc1 is kept reverse biased, the potential of the gate electrode Gs1 of the light-emitting thyristor L1 is also the power supply voltage Vga=−3.3 V, and thus the ON voltage Von thereof is −4.7 V. For this reason, in the period T(L2), the light-emitting thyristor L1 is not allowed to be turned on and thus emits no light even if the lighting signal ϕI transitions to the L level.

In other words, in the period T(Li), it is only the corresponding one of the light-emitting thyristors Li that is allowed to be turned on in the light-emitting thyristor array 102.

As has been described above, in each light-emitting element chip 51 in the first exemplary embodiment, control is performed such that, while the first clock signal ϕ1 set to the L level keeps one of the transfer thyristors Ti turned on, the second clock signal ϕ2 repeats transitions between the H level and the L level, and thus the corresponding light-emission control thyristor Ci is caused to repeat transitions between the on state (the L level) and the off state (the H level).

Here, the transfer thyristor Ti is kept turned on while the light-emission control thyristor Ci repeats transitions between the on state and the off state. This ensures that the position of the light-emitting thyristor Li set as a light-emission control target is not lost. In other words, the transfer thyristor Ti functions to hold position information of the light-emitting thyristor Li.

Meanwhile, when the light-emission control thyristor Ci gets turned on, the ON voltage Von of the corresponding light-emitting thyristor Li rises. At this time, if the lighting signal ϕI is the L level, the potential difference between the anode electrode and the cathode electrode of the light-emitting thyristor Li is lower than its ON voltage Von, so that the light-emitting thyristor Li starts emitting light. On the other hand, if the lighting signal ϕI is the H level at that time, the potential difference between the anode electrode and the cathode electrode of the light-emitting thyristor Li is not lower than its ON voltage Von, so that the light-emitting thyristor Li continues to emit no light.

In other words, the signal generating circuit 110, the light-emission control thyristors Ci and the transfer thyristors Ti, all of which are an example of a specifying unit, sequentially specify targets for controlling whether or not to emit light one by one from the light-emitting thyristors Li in the following manner. Specifically, a light-emission control target is specified by sequentially turning on the corresponding transfer thyristor Ti and the corresponding light-emission control thyristor Ci in accordance respectively with the first and second clock signals ϕ1 and ϕ2 outputted by the signal generating circuit 110. In other words, by being turned on after the transfer thyristor Ti gets turned on, the light-emission control thyristor Ci functions to set the light-emitting thyristor Li ready to emit light.

Here, as long as the light-emission enable signal En is at the H level, the light-emission enable thyristor Td is turned on even if the second clock signal ϕ2 becomes the L level.

Accordingly, in this case, the second clock signal line 73 is fixed at −1.4 V, thus preventing the second clock signal line 73 from following the second clock signal ϕ2 to transition to the L level. Thus, the light-emission enable signal En provides not only control on whether or not to allow the light-emitting thyristors Li to actually emit light, but also control on a light-emitting period of each light-emitting thyristor Li. The latter control is achieved by adjusting the timing at which the light-emission enable signal En transitions to the L level to control the time point when the light-emitting thyristor Li starts emitting light. Note that the light-emitting thyristor Li starts emitting light at the first time point when the second clock signal ϕ2 transitions from the H level to the L level after the light-emission enable signal En becomes the L level (the time point g in FIG. 6).

In other words, the signal generating circuit 110 and the light-emission enable thyristor Td, which are an example of an adjusting unit, adjusts the light-emitting period of each light-emitting thyristor Li in the following manner. Specifically, when being turned on in accordance with the light-emission enable signal En outputted by the signal generating circuit 110, the light-emission enable thyristor Td supplies the gate electrode Gsi of each light-emitting thyristor Li with the maintaining voltage instead of the transition voltage to prevent the light-emitting thyristor Li from starting emitting light, and stops supplying the maintaining voltage at a variable timing.

Here, the second clock signal ϕ2 is a signal for turning on either the light-emission enable thyristor Td or any of the light-emission control thyristors Ci.

As shown in FIG. 6 as an example, the first light-emission enable signal En1 transitions from the H level to the L level at different timings (the time points f and t in FIG. 6) in the respective periods T(L1) and T(L2), so that the supply of the maintaining voltage is stopped at a different timing in the period T(L1) from in the period T(L2). As a result, the light-emitting thyristors L1 and L2 have different light-emitting periods from each other.

As described above, by performing control in the period T(Li) to cause the second clock signal ϕ2 to have a cycle period shorter than the period T(Li), and to cause the light-emission enable signal En to transition from the H level to the L level at different timings in the respective periods T(Li), the light-emitting thyristors Li start emitting light at different time points and thus have different light-emitting periods in the periods T(Li), respectively.

Note that the controllable range of the time point when each light-emitting thyristor Li starts emitting light depends on the cycle period provided to the second clock signal ϕ2.

Alternatively, the time point when the light-emitting thyristor Li starts emitting light may be controlled by performing control to cause the second clock signal ϕ2 to transition from the H level to the L level at different timings while the light-emission enable signal En is at the L level in the respective periods T(Li).

Note that the light-emitting thyristor Li may be caused to emit no light in the corresponding period T(Li) only by keeping the light-emission enable signal En at the H level during the entire period T(Li). In this case, since the light-emission enable signal En is kept at the H level in the light-emitting element chip 51 which is supplied with the first and second clock signals ϕ1 and ϕ2 and the lighting signal ϕI, if the second clock signal ϕ2 becomes the L level, the light-emission enable thyristor Td gets turned on to fix the potential of the second clock signal line 73 at −1.4 V. Accordingly, the light-emission control thyristors Ci are prevented from following the second clock signal ϕ2 to get turned on. Thus, in this case, none of the light-emitting thyristors Li is allowed to be turned on, and thus emits no light.

In addition, in the periods T(#2) to T(#5), all the light-emitting thyristors Li in #1 of the light-emitting element chips 51 are prevented from emitting light. This may also be achieved only by keeping the first light-emission enable signal En1 at the H level during the periods T(#2) to T(#5), as shown in FIG. 5. In this case as well, if the second clock signal ϕ2 becomes the L level, the light-emission enable thyristor Td gets turned on to fix the potential of the second clock signal line 73 at −1.4 V. Accordingly, none of the light-emission control thyristors Ci does not get turned on, and thus none of the light-emitting thyristors Li emits light in #1 of the light-emitting element chips 51.

On the other hand, once turned on, the light-emitting thyristor L1 continues to emit light regardless of the potential of the gate electrode Gs1 till the lighting signal ϕI transitions to the H level. In other words, each light-emitting thyristor Li stops emitting light at a time point when the lighting signal ϕI transitions from the L level to the H level (the time point n in FIG. 6).

Note that, though the time point n when the light-emitting thyristor L1 stops emitting light may be set to any time point by using the lighting signal ϕI, the time point n may be set to a time point before the time point r when the period T(L2) for controlling the light-emitting thyristor L2 starts.

Meanwhile, the light-emission enable signal En is supplied only to the gate electrode Gt of the light-emission enable thyristor Td, and thus does not require any current buffer circuit having a large current drive capability. Additionally, once gets turned on, the light-emission enable thyristor Td is kept turned on regardless of the potential of the gate electrode Gt. This eliminates the need for the signal generating circuit 110 to keep supplying a current by using the light-emission enable signal En.

Figure 7:
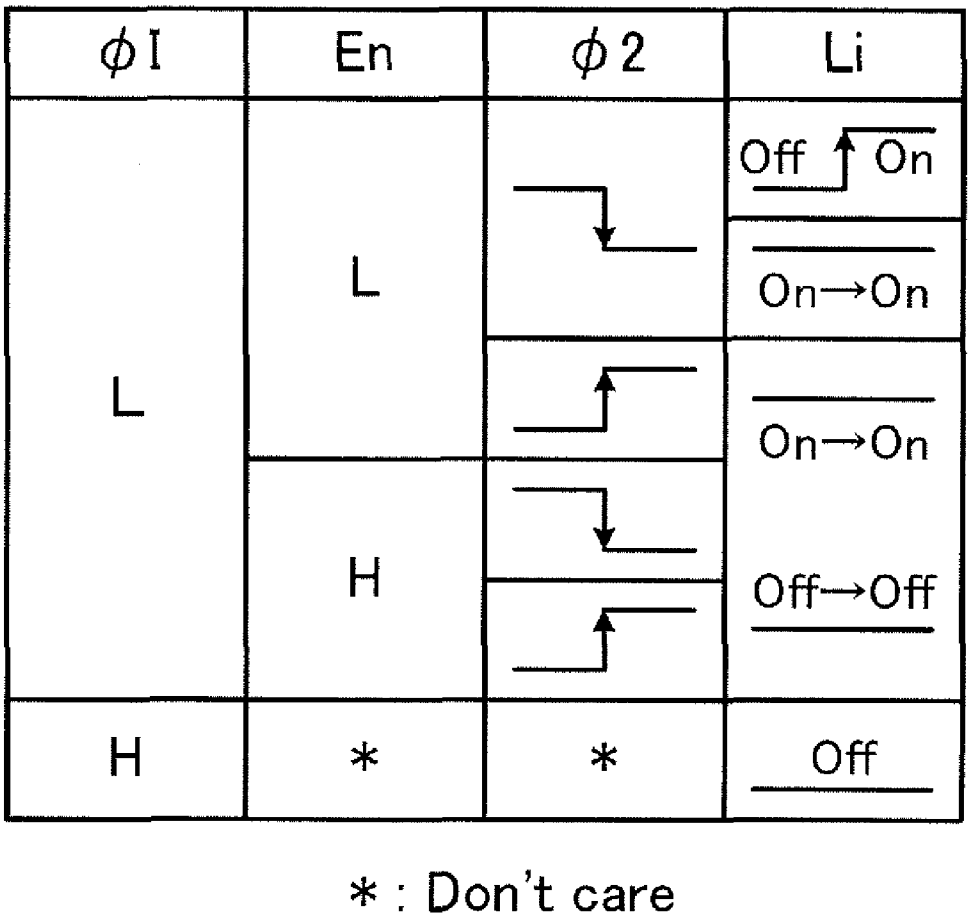
FIG. 7 is a state transition table for explaining the operation of each light-emitting element chip in the first exemplary embodiment.

FIG. 7 is a state transition table for explaining the operation of each light-emitting element chip 51. Note that FIG. 7 shows state transitions after the transfer thyristor Ti gets turned on in response to the transition to the L level of the first clock signal ϕ1.

Under the condition where the lighting signal ϕI and the light-emission enable signal En are both set to the L level, the light-emission enable thyristor Td does not get turned on. Suppose here the case that the second clock signal ϕ2 transitions from the H level to the L level under this condition. In this case, if the light-emitting thyristor Li is turned off, it gets turned on to start emitting light (the time point g in FIG. 6), and, if the light-emitting thyristor Li is turned on, it is kept turned on (the time point i in FIG. 6).

By contrast, if the second clock signal ϕ2 transitions from the L level to the H level even under the condition that the lighting signal ϕI and the light-emission enable signal En are both set to the L level, the state of the light-emitting thyristor Li does not change (the time points h and j in FIG. 6).

Meanwhile, if the second clock signal ϕ2 transitions from the H level to the L level under the condition that the lighting signal ϕ1 and the light-emission enable signal En are respectively set to the L level and the H level, the light-emission enable thyristor Td gets turned on. In this case, however, if the light-emitting thyristor Li is emitting light, it continues to emit light (the time point l in FIG. 6), and, if the light-emitting thyristor Li is emitting no light, it continues to emit no light (the time point d in FIG. 6). By contrast, if the second clock signal ϕ2 then transitions from the L level to the H level under this condition, the light-emission enable thyristor Td gets turned off. In this case as well, if the light-emitting thyristor Li is emitting light, it continues to emit light (the time point m in FIG. 6), and, if the light-emitting thyristor Li is emitting no light, it continues to emit no light (the time point e in FIG. 6).

Note that, as long as the lighting signal ϕI is at the H level, none of the light-emitting thyristor Li emits light regardless of the states of the light-emission enable signal En and the second clock signal ϕ2.

Figure 8:
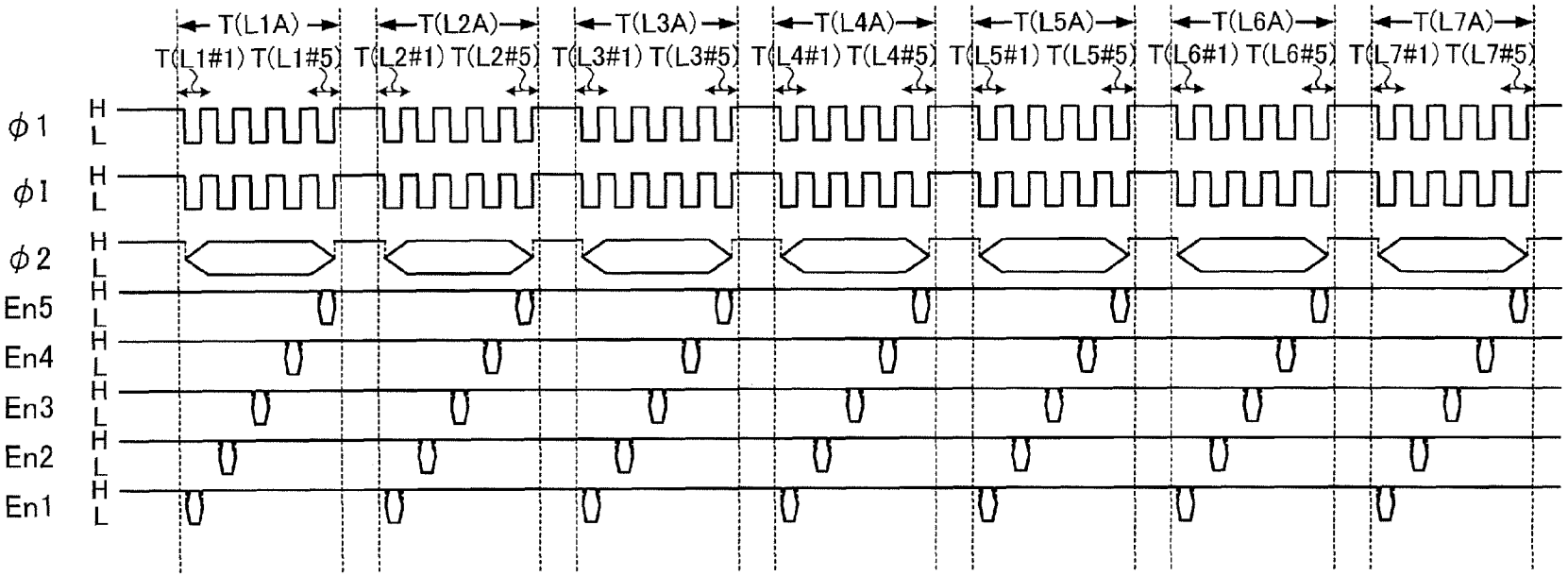
FIG. 8 is a time chart for explaining a second driving method of driving each light-emitting element head in the first exemplary embodiment.

FIG. 8 is a time chart for explaining a second driving method of driving each light-emitting element head 90 in the first exemplary embodiment.

In the second driving method, the light-emitting thyristors L1 to L7 provided in #1 to #5 of the light-emitting element chips 51 are divided into groups based on the numbers assigned to the respective light-emitting thyristors, and drive control of the groups is performed in order according to the numbers assigned to the light-emitting thyristors Li therein. Note that light-emitting operations of the light-emitting thyristors Li assigned the same number are controlled in order according to the numbers assigned to the light-emitting element chips 51, that is, #1, #2, . . . , #5. In the following description, periods during which drive control of the light-emitting thyristor groups L1 to L7 is performed will be referred to as periods T(L1A) to T(L7A), respectively. In addition, in each of the periods T(L1A) to T(L7A), periods during which the light-emitting operations of the light-emitting thyristors Li assigned the same number in #1 to #5 of the light-emitting element chips 51 are controlled will be referred to as periods T(Li#1) to T(Li#5), respectively.

In the initial state, all the light-emitting thyristors Li of #1 to #5 of the light-emitting element chips 51 are turned off.

The signal generating circuit 110 outputs the first clock signal ϕ1 that repeats a pair of a transition from the H level to the L level and a transition from the L level to the H level the same number of times as the number of the light-emitting element chips 51 (five times) in each of the periods T(L1A) to T(L7A).

In addition, the signal generating circuit 110 also outputs the lighting signal ϕI that repeats a pair of a transition from the H level to the L level and a transition from the L level to the H level the same number of times as the number of the light-emitting element chips 51 (five times) in each of the periods T(L1A) to T(L7A). Note that, as has been described above, the lighting signal ϕI transitions from the H level to the L level after the first clock signal ϕ1 transitions from the H level to the L level, and the lighting signal ϕI transitions from the L level to the H level before the first clock signal ϕ1 transitions from the L level to the H level.

The signal generating circuit 110 also outputs the second clock signal ϕ2 that repeats transitions between the H level and the L level in each of the periods T(L1A) to T(L7A).

Additionally, the signal generating circuit 110 also outputs the first to fifth light-emission enable signals En1 to En5. The first light-emission enable signal En1 transitions between the H level and the L level as necessary in the periods T(L1#1), T(L2#1), . . . , T(L7#1) respectively in the periods T(L1A) to T(L7A), but the first light-emission enable signal En1 is fixed at the H level in the other periods T(Li#2) to T(Li#5). The second light-emission enable signal En2 transitions between the H level and the L level as necessary in the periods T(L1#2), T(L2#2), . . . , T(L7#2) respectively in the periods T(L1A) to T(L7A), but the second light-emission enable signal En2 is fixed at the H level in the other periods T(Li#1) and T(Li#3) to T(Li#5). The third light-emission enable signal En3 transitions between the H level and the L level as necessary in the periods T(L1#3), T(L2#3), . . . , T(L7#3) respectively in the periods T(L1A) to T(L7A), but the third light-emission enable signal En3 is fixed at the H level in the other periods T(Li#1), T(Li#2), T(Li#4) and T(Li#5). The fourth light-emission enable signal En4 transitions between the H level and the L level as necessary in the periods T(L1#4), T(L2#4), . . . , T(L7#4) respectively in the periods T(L1A) to T(L7A), but the fourth light-emission enable signal En4 is fixed at the H level in the other periods T(Li#1) to T(Li#3) and T(Li#5). The fifth light-emission enable signal En5 transitions between the H level and the L level as necessary in the periods T(L1#5), T(L2#5), . . . , T(L7#5) respectively in the periods T(L1A) to T(L7A), but the fifth light-emission enable signal En5 is fixed at the H level in the other periods T(Li#1) to T(Li#4).

For example, in the period T(L1A), the light-emitting operations of the light-emitting thyristors L1 provided in #1 to #5 of the light-emitting element chips 51 are controlled by using the first and second clock signals ϕ1 and ϕ2, the lighting signal ϕI and the first to fifth light-emission enable signals En1 to En5. Here, the first and second clock signals ϕ1 and ϕ2, and the lighting signal ϕI are supplied in common to #1 to #5 of the light-emitting element chips 51, while the first to fifth light-emission enable signals En1 to En5 are respectively supplied to #1 to #5 of the light-emitting element chips 51. At this time, the light-emitting operation of the light-emitting thyristor L1 in #1 of the light-emitting element chips 51 is controlled in the period T(L1#1) of the period T(L1A), and the light-emitting operation of the light-emitting thyristor L1 in #5 of the light-emitting element chips 51 is controlled in the period T(L1#5) of the period T(L1A), for example. Note that the light-emitting thyristors L1 in #2 to #4 of the light-emitting element chips 51 are controlled in a similar manner in the periods T(L1#2) to T(L1#4) of the period T(L1A), respectively. Specifically, in each of the periods T(L1#2) to T(L1#4), the light-emitting operation of the light-emitting thyristor L1 provided in the corresponding one of #2 to #4 of the light-emitting element chips 51 is controlled by using the first and second clock signals ϕ1 and ϕ2, the lighting signal ϕI and the corresponding one of the second to fourth light-emission enable signals En2 to En4. Here, the first and second clock signals ϕ1 and ϕ2, the lighting signal ϕ1 are supplied in common to all the light-emitting element chips 51, while the second to fourth light-emission enable signals En2 to En4 are supplied respectively to #2 to #4 of the light-emitting element chips 51.

In addition, as in the above, the light-emitting thyristors L2 to L7 provided in #1 to #5 of the light-emitting element chips 51 are controlled in the periods T(L2A) to T(L7A). Specifically, in each of the periods T(L2A) to T(L7A), the light-emitting operation of the corresponding group of the light-emitting thyristors L2 to L7 provided in #1 to #5 of the light-emitting element chips 51 is controlled by using the first and second clock signals ϕ1 and ϕ2, the lighting signal ϕI and the first to fifth light-emission enable signals En1 to En5. Here, the first and second clock signals ϕ1 and ϕ2, the lighting signal ϕI are supplied in common to all the light-emitting element chips 51, while the first to fifth light-emission enable signals En1 to En5 are supplied respectively to #1 to #5 of the light-emitting element chips 51.

The second driving method may be obtained by changing the light-emission enable signals En in the first driving method shown in FIG. 6 to those mentioned above.

Note that, though the first and second clock signals ϕ1 and ϕ2, and the lighting signal ϕI are supplied in common to all the light-emitting element chips 51 in FIG. 3, any or all of these signals do not necessarily be supplied in common to all the light-emitting element chips 51. Instead, the multiple light-emitting element chips 51 may be divided into groups, and the signals may be supplied to the respective groups in a manner that any or all of the signals are different for each group.

As has been described above, in the first exemplary embodiment, by using the light-emission enable signal En to control whether or not the light-emitting thyristors Li emit light, the lighting signal ϕI is commonly used for the multiple light-emitting element chips 51. This reduces the number of current buffer circuits for supplying the lighting signals ϕI, each of which has a large current drive capability.

In addition, the light-emission enable signal En, which is supplied to the gate electrode Gt of the light-emission enable thyristor Td, functions to raise the ON voltage Von thereof for turning on the light-emission enable thyristor Td. Accordingly, the light-emission enable signal En may be supplied using a small current, unlike a large current that needs to be supplied to the anode electrode or the cathode electrode of the light-emission enable thyristor Td in order to turn it on.

As a result, in the light-emitting element head 90, the required number of current buffer circuits each having a large current drive capability is reduced, while the multiple light-emission enable signals En are supplied using a small current.

(Second Exemplary Embodiment)

Figure 9:
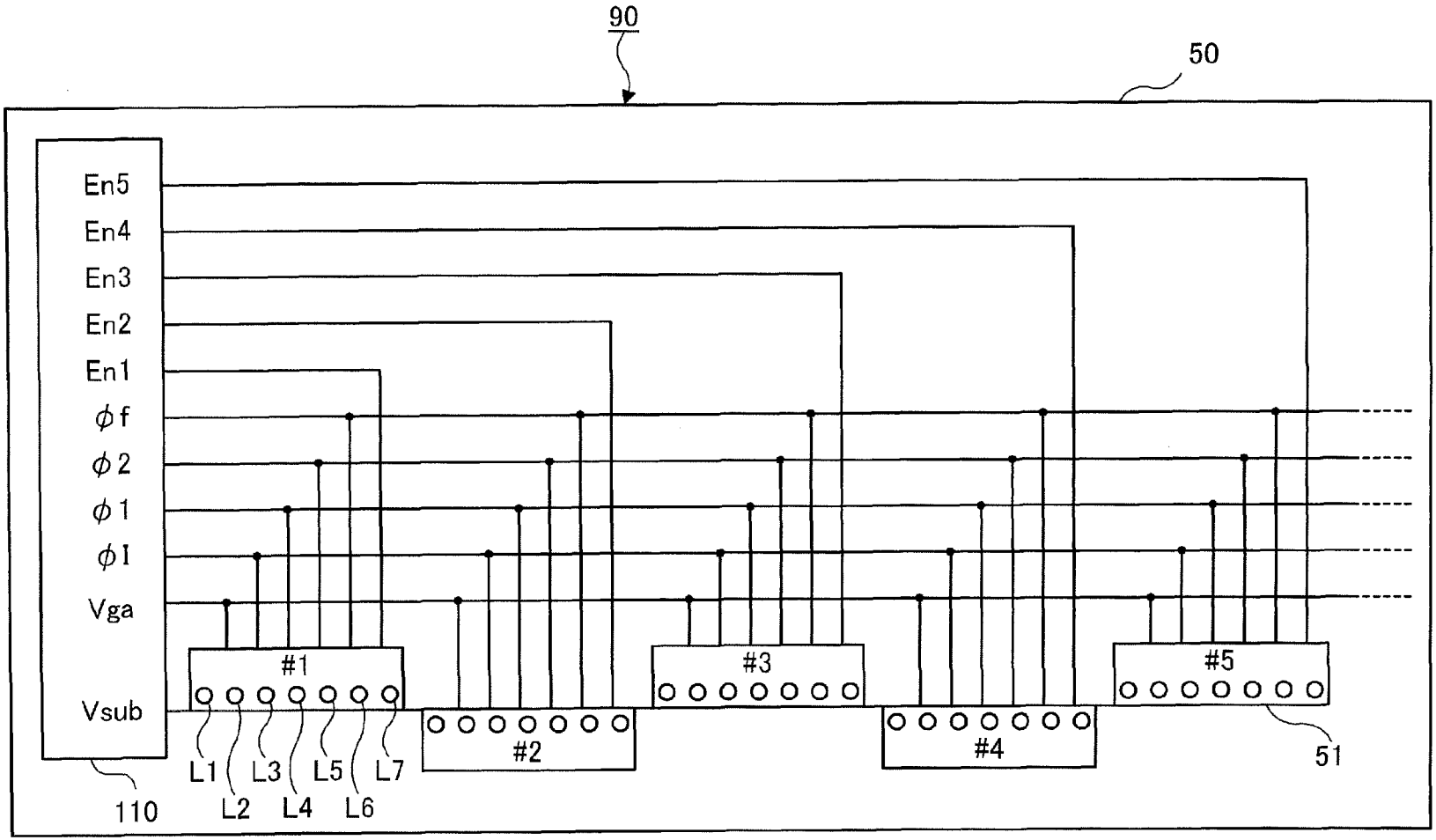
FIG. 9 is a schematic view for explaining a configuration of each light-emitting element head in the second exemplary embodiment.

FIG. 9 is a schematic view for explaining a configuration of each light-emitting element head 90 in the second exemplary embodiment.

The signal generating circuit 110 in the second exemplary embodiment supplies a firing signal ϕf in addition to the first and second clock signals ϕ1 and ϕ2, the lighting signal ϕI, the first to fifth light-emission enable signals En1 to En5, the power supply voltage Vga and the reference voltage Vsub. Note that the signal generating circuit 110 supplies the firing signal ϕf in common to all the light-emitting element chips 51.

Hereinbelow, components in the second exemplary embodiment similar to those in the first exemplary embodiment will be denoted by the same reference numerals, and the detailed description thereof will be omitted.

Figure 10:
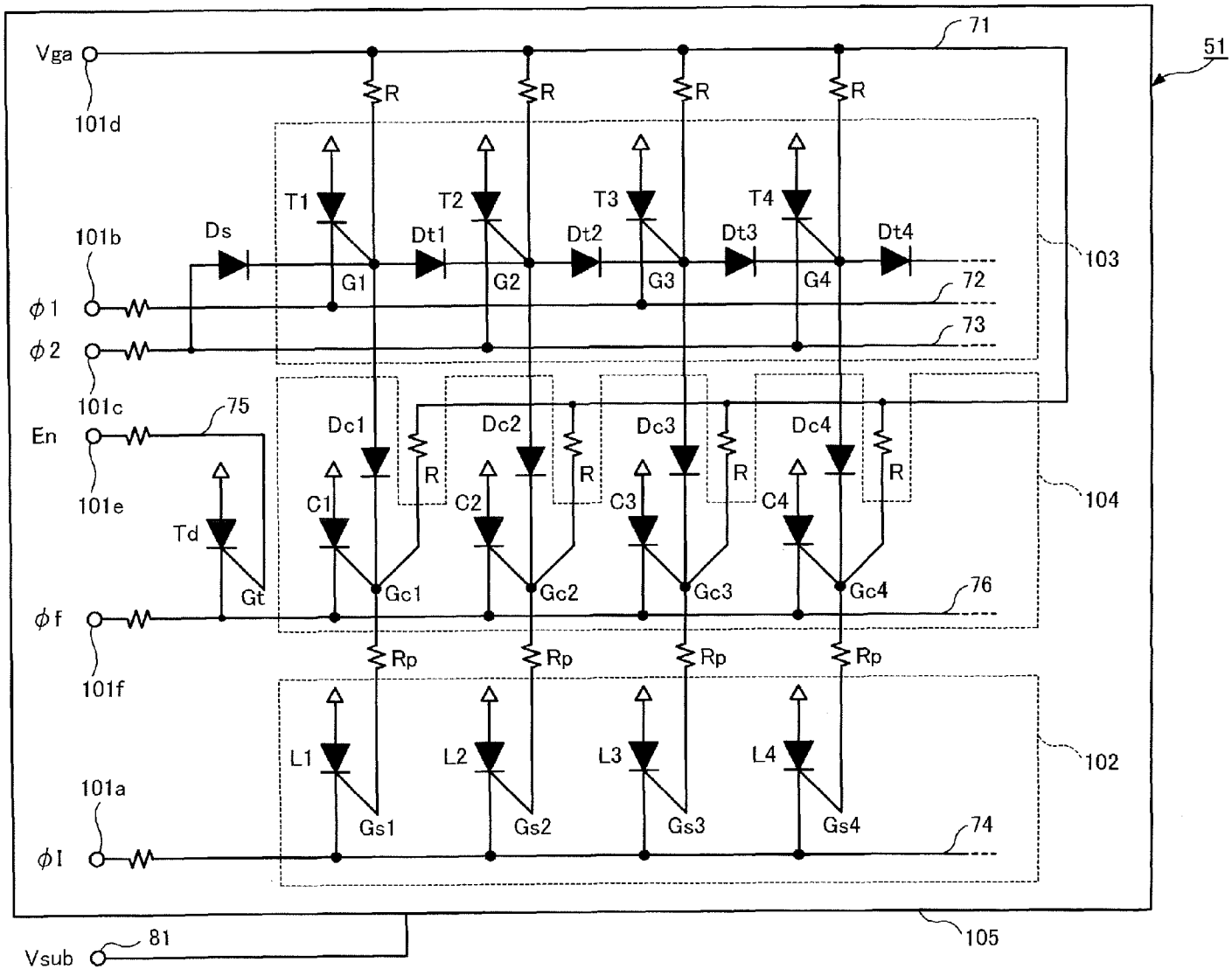
FIG. 10 is a schematic view of an equivalent circuit and a planar layout of each light-emitting element chip in the second exemplary embodiment.

FIG. 10 is a schematic view of an equivalent circuit and a planar layout of each light-emitting element chip 51 in the second exemplary embodiment.

As shown in FIG. 10, in the light-emitting element chip 51 of the second exemplary embodiment, the transfer thyristor array 103, the light-emission control thyristor array 104 and the light-emitting thyristor array 102 are arranged side by side in the up-and-down direction of FIG. 10 so as to form three parallel lines. Specifically, in this arrangement, the transfer thyristor Ti, the light-emission control thyristor Ci and the light-emitting thyristor Li assigned the same number as one another are arranged in a line extending in the up-and-down direction of FIG. 10. Note that each transfer thyristor Ti is connected to the light-emission control thyristor Ci assigned the same number as that of the transfer thyristor Ti, and each light-emission control thyristor Ci is connected to the light-emitting thyristor Li assigned the same number as that of the light-emission control thyristor Ci.

This allows the light-emitting thyristors Li to be arrayed at shorter intervals (at approximately half-length intervals in this example) in each light-emitting element chip 51 in the second exemplary embodiment than in the first exemplary embodiment.

Note that, in principle, the light-emitting thyristors Li may be arrayed at shorter intervals even in the light-emitting element chip 51 in the first exemplary embodiment by arranging the transfer thyristor Ti, the light-emission control thyristor Ci and the light-emitting thyristor Li assigned the same number as one another in a line. However, this complicates the routing of lines in the light-emitting element chip 51.

By contrast, in the light-emitting element chip 51 in the second exemplary embodiment, despite additional provision of the firing signal ϕf, the light-emitting thyristors Li may be formed at shorter intervals without complicating the routing of the lines in light-emitting element chip 51.

Next, a description will be given of the connection relation and the positional relation of the elements in the light-emitting element chip 51 with reference to FIG. 10. In the following, only differences from the first exemplary embodiment will be described, and a redundant description will be omitted.

The gate electrode Gi of each transfer thyristor Ti is connected to the gate electrode Gi+1 of the transfer thyristor Ti+1 adjacent to the transfer thyristor Ti, via the corresponding connecting diode Dti. Here, each connecting diode Dti is connected with its orientation set to allow a current to flow from the gate electrode G1 to the gate electrode G1+1.

In other words, unlike the first exemplary embodiment, in which the transfer thyristors Ti and the light-emission control thyristors Ci are alternately connected via the connecting diodes Dti or Dci, the light-emitting element chip 51 in the second exemplary embodiment has a configuration in which each transfer thyristor Ti is connected to the transfer thyristor Ti+1 via the corresponding connecting diode Dti.

In addition, the gate electrode G1 of each transfer thyristor Ti is connected to the gate electrode Gci of the light-emission control thyristor Ci via the corresponding connecting diode Dci. Here, each connecting diode Dci is connected with its orientation set to allow a current to flow from the gate electrode Gi to the gate electrode Gci.

In other words, unlike the first exemplary embodiment, in which each connecting diode Dti is connected between the gate electrode Gi of the transfer thyristor Ti and the gate electrode Gci of the light-emission control thyristor Ci, the light-emitting element chip 51 in the second exemplary embodiment has a configuration in which each connecting diode Dti is connected between the gate electrode Gi of the transfer thyristor Ti and the gate electrode G1+1 of the transfer thyristor Ti+1. Additionally, unlike the first exemplary embodiment, in which each connecting diode Dci is connected between the gate electrode Gci of the light-emission control thyristor Ci and the gate electrode Gi+1 of the transfer thyristor Ti+1, the light-emitting element chip 51 in the second exemplary embodiment has a configuration in which each connecting diode Dci is connected between the gate electrode Gi of the transfer thyristor Ti and the gate electrode Gci of the light-emission control thyristor Ci.

Moreover, the gate electrode Gci of each light-emission control thyristor Ci is connected to the gate electrode Gsi of the corresponding light-emitting thyristor Li via the corresponding resistor Rp.

The cathode electrode of each odd-numbered transfer thyristor T2*i*−1 is connected to the first clock signal line 72, while the cathode electrode of each even-numbered transfer thyristor T2*i* is connected to the second clock signal line 73.

Meanwhile, the cathode electrode of each light-emission control thyristor Ci is connected to a firing signal line 76, which is additionally provided.

The cathode electrode of the light-emission enable thyristor Td is connected to this additionally provided firing signal line 76. Via a resistor, the firing signal line 76 is connected to a firing signal terminal 101*f*, which is supplied with the firing signal ϕf.

Thus, in terms of connection relations respectively of the anode electrode and the cathode electrode, it may be said that the light-emission enable thyristor Td is connected in parallel to the light-emission control thyristors Ci, as in the first exemplary embodiment. In this regard, the cathode electrode of the light-emission enable thyristor Td is connected to the firing signal line 76 at a position closer to the firing signal terminal 101*f* than any of the light-emission control thyristors Ci is.

Figure 11:
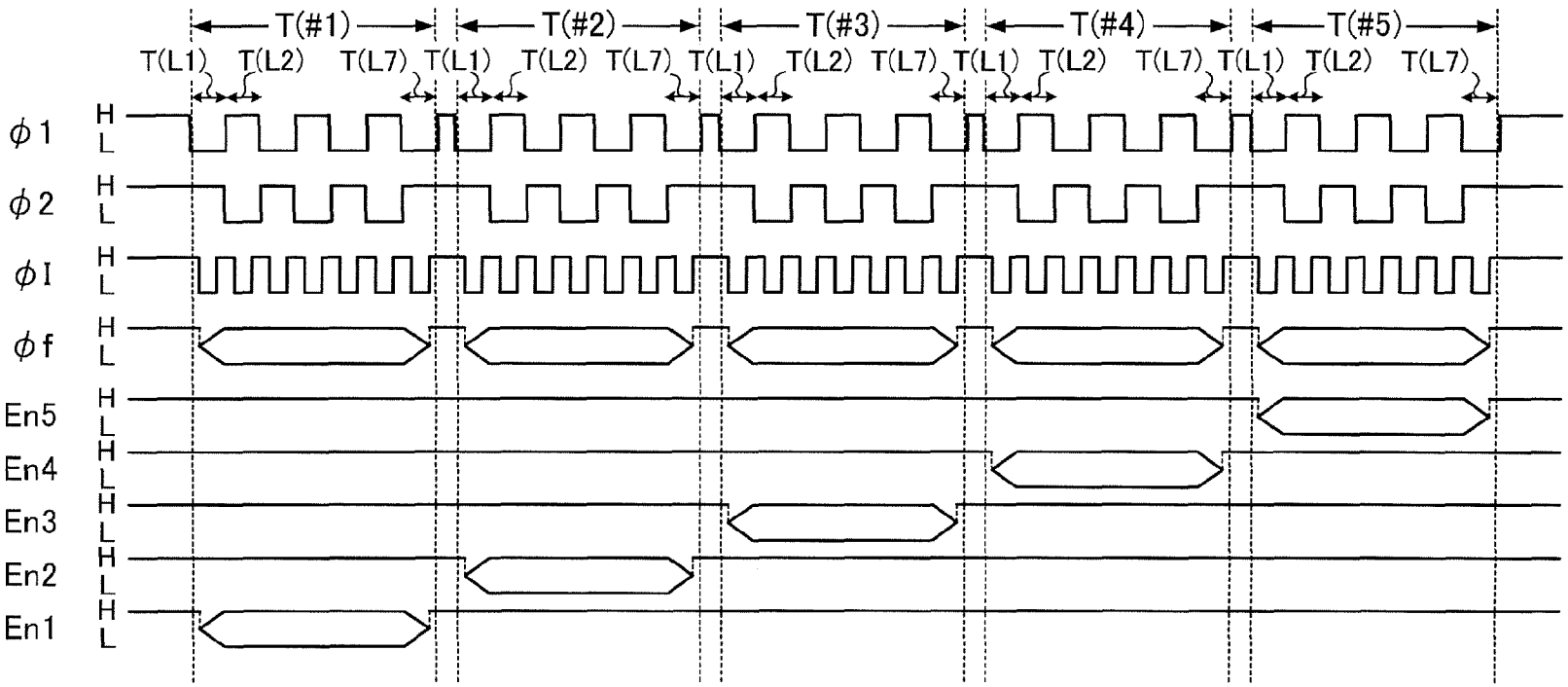
FIG. 11 is a time chart for explaining a driving method of driving each light-emitting element head in the second exemplary embodiment.

FIG. 11 is a time chart for explaining a driving method of driving each light-emitting element head 90 in the second exemplary embodiment. This driving method is comparable to the first driving method in the first exemplary embodiment shown in FIG. 5.

The signal generating circuit 110 outputs the first and second clock signals ϕ1 and ϕ2 each of which repeats a pair of a transition from the H level to the L level and a transition from the L level to the H level multiple times in each of the periods T(#1) to T(#5). Specifically, the first clock signal ϕ1 repeats the pair of transitions four times, while the second clock signal ϕ2 repeats the pair of transitions three times. Here, the first and second clock signals ϕ1 and ϕ2 transition in association with each other in a manner that one is at the H level when the other is at the L level, and that one is at the L level when the other is at the H level, basically. Note that, as will be described later, the first clock signal ϕ1 transitions from the L level to the H level after the second clock signal ϕ2 transitions from the H level to the L level, and the first clock signal ϕ1 transitions from the H level to the L level before the second clock signal ϕ2 transitions from the L level to the H level. In other words, in the second exemplary embodiment, the first and second clock signals ϕ1 and ϕ2 are caused to transition in a manner that both of them are temporally set to the L level every time before one of them transitions to the H level while the other remains at the L level. The total number of the periods when the first clock signal ϕ1 is at the L level and the periods when the second clock signal ϕ2 is at the L level is the same as the number of the light-emitting thyristors Li in the light-emitting element chip 51 (seven).

Note that each of the periods T(L1) to T(L7) is nearly equivalent to a period in which either of the first and second clock signals ϕ1 and ϕ2 is at the L level.

In addition, the signal generating circuit 110 also outputs the lighting signal ϕI that repeats a pair of a transition from the H level to the L level and a transition from the L level to the H level the same number of times as the number of the light-emitting thyristors Li in the light-emitting element chip 51 (seven times) in each of the periods T(#1) to T(#5). To be more precise, the lighting signal ϕI has such a pair of transitions in each period in which either of the first and second clock signals ϕ1 and ϕ2 is at the L level. Note that, as will be described later, the lighting signal ϕI transitions from the H level to the L level after both of the first and second clock signals ϕ1 and ϕ2 are temporally set to the L level, and after any one of the first and second clock signals ϕ1 and ϕ2 transitions to the H level, and the lighting signal ϕI transitions from the L level to the H level before one of the first and second clock signals ϕ1 and ϕ2 is at the H level and the other is at the L level, and before both of the first and second clock signals ϕ1 and ϕ2 are temporally set to the L level.

In addition, the signal generating circuit 110 also outputs the firing signal ϕf that repeats transitions between the H level and the L level in each of the periods T(#1) to T(#5).

Additionally, the signal generating circuit 110 also outputs the first to fifth light-emission enable signals En1 to En5 as in the first exemplary embodiment.

For example, in the period T(#1), the light-emitting operations of the light-emitting thyristors Li provided in #1 of the light-emitting element chips 51 are controlled by using the first and second clock signals ϕ1 and ϕ2, the lighting signal ϕI, the firing signal ϕf and the first light-emission enable signal En1. Here, the first and second clock signals ϕ1 and ϕ2, the lighting signal ϕI and the firing signal ϕf are supplied in common to #1 to #5 of the light-emitting element chips 51, while the first light-emission enable signal En1 is supplied only to #1 of the light-emitting element chips 51. Note that #2 to #5 of the light-emitting element chips 51 are controlled in a similar manner.

Figure 12:
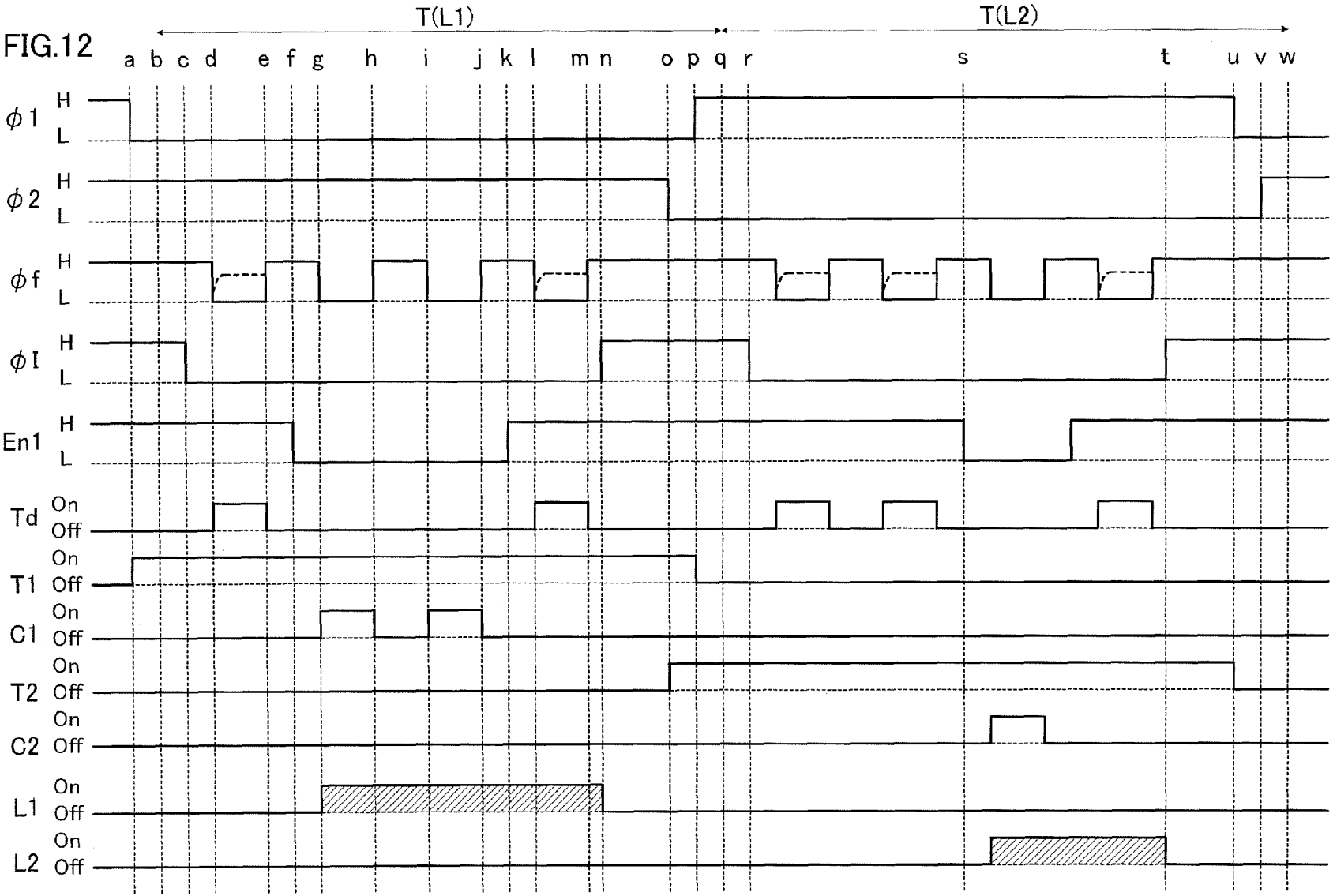
FIG. 12 is a time chart for explaining operations of the light-emitting element chips in the second exemplary embodiment.

FIG. 12 is a time chart for explaining operations of the light-emitting element chips 51 in the driving method shown in FIG. 11. Here, a description will be given of an operation of one of the light-emitting element chips 51 alone, by using, as an example, #1 of the light-emitting element chips 51 whose drive control is performed in the period T(#1). Thus, in this example, among the light-emission enable signals En, the first light-emission enable signal En1 is supplied to the light-emitting element chip 51. Specifically, FIG. 12 illustrates light-emission control of the two light-emitting thyristors L1 and L2 among the seven light-emitting thyristors L1 to L7 provided in #1 of the light-emitting element chips 51. Note that, in this example, a period from a time point b to a time point q is the period T(L1) for controlling the light-emitting operation of the light-emitting thyristor L1, while a period from the time point q to a time point w is the period T(L2) for controlling the light-emitting operation of the light-emitting thyristor L2.

The first clock signal ϕ1, which repeats the cycle of the total period of the periods T(L1) and T(L2), is at the L level during a period from the time point b to a time point p, at the H level during a period from the time point p to a time point u, and at the L level during a period from the time point u to the time point w. The second clock signal ϕ2, which repeats the cycle of the total period of the periods T(L1) and T(L2), too, is at the H level during a period from the time point b to a time point o, at the L level during a period from the time point o to a time point v, and at the H level during a period from the time point v to the time point w.

The firing signal ϕf cyclically repeats transitions between the H level and the L level multiple times both in the period from the time point b to the time point o in the period T(L1) and in a period from the time point q to the time point u in the period T(L2).

Meanwhile, in the period T(L1), the lighting signal ϕI is at the L level during a period from a time point c to a time point n, and at the H level during the other periods. Accordingly, in the period T(L1), the lighting signal ϕI becomes the L level after the first clock signal ϕ1 transitions to the L level, and becomes the H level before the second clock signal ϕ2 transitions to the L level. Then, in the period T(L2), the lighting signal ϕI becomes the L level after the first clock signal ϕ1 transitions to the H level, and becomes the H level before the first clock signal ϕ1 transitions to the L level.

Each of the firing signal ϕf and the lighting signal ϕI repeats the cycle of the period T(Li).

As described above, FIG. 12 is different from FIG. 6 in the waveforms of the first and second clock signals ϕ1 and ϕ2. In addition, the waveform of the firing signal ϕf in the second exemplary embodiment is the same as that of the second clock signal ϕ2 in the first exemplary embodiment. In the following, the operational differences due to those differences will be mainly described.

In the initial state (just before a time point a), the transfer thyristors Ti, the light-emission control thyristors Ci, the light-emitting thyristors Li and the light-emission enable thyristor Td are all turned off. In this state, the first and second clock signals ϕ1 and ϕ2, the first light-emission enable signal En1 and the firing signal ϕf are all set to the H level.

At the time point a, the first clock signal ϕ1 transitions from the H level to the L level. In response, the transfer thyristor T1 gets turned on as in the first exemplary embodiment.

When the transfer thyristor T1 gets turned on, the potential of the gate electrode G1 rises to approximately the H level of 0 V. The effect of this potential rise is transmitted to the gate electrode G2 through the connecting diode Dt1 that gets forward biased. In response, the potential of the gate electrode G2 rises to −1.4 V, which is the forward threshold voltage Vd of the pn junction, and thus the ON voltage Von of the transfer thyristor T2 rises to −2.8 V.

This further causes the potential of the gate electrode G3 of the transfer thyristor T3 to rise to −2.8 V, and thus the ON voltage Von of the transfer thyristor T3 rises to −4.2 V. Meanwhile, the potential of the gate electrodes G4, . . . , of the transfer thyristors T4, . . . , remains set to −3.3 V, and thus the ON voltage Von thereof remains −4.7 V.

The effect of the potential rise to approximately the H level of 0 V of the gate electrode G1 is transmitted to the gate electrode Gc1 of the light-emission control thyristor C1 through the connecting diode Dc1 that gets forward biased. In response, the potential of the gate electrode Gc1 rises to −1.4 V, which is the forward threshold voltage Vd of the pn junction, and thus the ON voltage Von of the light-emission control thyristor C1 rises to −2.8 V.

Meanwhile, in response to the potential rise to −1.4 V of the gate electrode G2, the potential of the gate electrode Gc2 rises to −2.8 V, and thus the ON voltage Von of the light-emission control thyristor C2 rises to −4.2 V. Meanwhile, the potential of the gate electrodes Gc3, Gc4, of the light-emission control thyristors C3, C4, remains set to the power supply voltage Vga=−3.3 V, and thus the ON voltage Von of these light-emission control thyristors remains −4.7 V.

The potential of the gate electrode Gs1 of the light-emitting thyristor L1 becomes a voltage based on both the forward threshold voltage Vd of the pn junction in the connecting diode Dc1 and the voltage drop (δ) caused by the corresponding resistor Rp as a parasitic resistance, that is, becomes −Vd+δ=−2.2 V. Thus, the ON voltage Von of the light-emitting thyristor L1 rises to −3.6 V. Meanwhile, the potential of the gate electrodes Gs2, Gs3, . . . , of the light-emitting thyristors L2, L3, . . . , remains set to the power supply voltage Vga=−3.3 V, and thus the ON voltage Von of these light-emitting thyristors remains −4.7 V.

At the time point c, that is, after the transfer thyristor T1 gets turned on at the time point a, the lighting signal ϕI transitions from the H level to the L level (−3.3 V). However, none of the light-emitting thyristors Li is turned on to emit light.

Then, at a time point d, the voltage of the firing signal ϕf is caused to transition to a voltage lower than −2.8 V but higher than −4.7 V, such as the power supply voltage Vga=−3.3 V (L level). In response, as described in the first exemplary embodiment, the light-emission enable thyristor Td is turned on, and this causes the potential of the firing signal line 76, to which the anode electrode of the light-emission enable thyristor Td is connected, to immediately rise and be fixed at −1.4 V, which is the forward threshold voltage Vd of the pn junction, (this state is expressed by the dashed line drawn in a period from the time point d to a time point e in FIG. 12).

Accordingly, the light-emission control thyristor C1 remains turned off, and thus none of the light-emitting thyristors Li emits light.

Then, at a time point f, the first light-emission enable signal En1 transitions to the L level of −3.3 V. In response, the ON voltage Von of the light-emission enable thyristor Td drops to −4.7 V. Accordingly, at a time point g, though the firing signal ϕf transitions to the L level, the light-emission enable thyristor Td is not allowed to be turned on. As a result, the light-emission control thyristor C1 gets turned on in response to this transition to the L level of the firing signal ϕf.

This raises the potential of the gate electrode Gc1 to approximately the H level of 0 V. In response, the potential of the gate electrode Gs1 is set to −0.8 V, and thus the ON voltage Von of the light-emitting thyristor L1 rises to −2.2 V. At this time, the lighting signal ϕI remains set to the L level (−3.3 V). Accordingly, in the light-emitting thyristor array 102, only the light-emitting thyristor L1 gets turned on, and thus starts emitting light.

As in the first exemplary embodiment, at the time point n, the lighting signal ϕI transitions from the L level to the H level, so that the light-emitting thyristor L1 is no longer allowed to keep turned on, and gets turned off. Thus, the light-emitting thyristor L1 stops emitting light.

Then, at a time point o, the second clock signal ϕ2 transitions to the L level, and thus the transfer thyristor T2 gets turned on. As a result, the transfer thyristors T1 and T2 are both turned on. In response, the potential of the gate electrode G2 rises to approximately the H level of 0 V, and the effect of this potential rise is transmitted to the gate electrode G3 through the connecting diode Dt2 that gets forward biased. In response, the potential of the gate electrode G3 is set to −1.4 V, which is the forward threshold voltage Vd of the pn junction, and thus the ON voltage Von of the transfer thyristor T3 rises to −2.8 V.

Then, at the time point p, the first clock signal ϕ1 transitions to the H level, and thus the transfer thyristor T1 gets turned off. Meanwhile, the transfer thyristor T2 is kept turned on. At the time point q, immediately after the time point p, the period T(L1) for controlling the light-emitting operation of the light-emitting thyristor L1 ends and the period T(L2) for controlling the light-emitting operation of the light-emitting thyristor L2 starts. The operations in the period T(L2), which will not be specifically described here, may be achieved simply by repeating all the operations performed at and after the time point b except those regarding the first and second clock signals ϕ1 and ϕ2. The operations in the period T(L3) for controlling the light-emitting operation of the light-emitting thyristor L3 and the subsequent periods T(Li) may be achieved simply by repeating the operations performed at and after the time point b by using, as a cycle, the total period of the periods T(L1) and T(L2).

Note that, in the period T(L2), even if the transfer thyristor T2 is turned on, so that the potential of the gate electrode G2 rises to approximately the H level of 0 V, the effect of this electronic potential rise is not transmitted to the gate electrode G1 since the connecting diodes Dt1 is reverse biased in this period. Accordingly, during the period T(L2), the ON voltage Von of the transfer thyristor T1 is −4.7 V. For this reason, though the first clock signal ϕ1 transitions to the L level at the time point u, the transfer thyristor T1 does not get turned on any more.

In each period T(Li) excluding the period during which the first and second clock signals ϕ1 and ϕ2 are both set to the L level, it is only the corresponding one of the transfer thyristors Ti that is allowed to be turned on in the transfer thyristor array 103. In the period during which the first and second clock signals ϕ1 and ϕ2 are both set to the L level (in a period from the time point o to the time point p in FIG. 12, for example), however, the transfer thyristors Ti and Ti+1 are both turned on.

Similarly, in the period T(Li), it is only the corresponding one of the light-emission control thyristors Ci that is allowed to be turned on in the light-emission control thyristor array 104.

Moreover, in the period T(Li), it is only the corresponding one of the light-emitting thyristors Li that is allowed to be turned on in the light-emitting thyristor array 102.

As has been described above, by being sequentially turned on, the transfer thyristors Ti function to specify light-emission control targets one by one from the light-emitting thyristors Li in numerical order.

Meanwhile, as in the first exemplary embodiment, by being turned on after each transfer thyristor Ti gets turned on, the corresponding light-emission control thyristor Ci functions to set the corresponding light-emitting thyristor Li ready to emit light.

However, if the light-emission enable thyristor Td is turned on, so that the firing signal line 76 is fixed at −1.4 V, the light-emission control thyristors Ci are not allowed to be turned on, and thus disabled to set the light-emitting thyristors Li ready to emit light. Thus, as in the first exemplary embodiment, the light-emission enable signals En provide not only control on whether or not to allow each light-emitting element chip 51 to emit light, but also control on a light-emitting period of each light-emitting thyristor Li. The latter control is achieved by adjusting the timing at which the light-emission enable signal En transitions to the L level to control the time point when the light-emitting thyristor Li starts emitting light.

As described above, in the second exemplary embodiment, the first and second clock signals ϕ1 and ϕ2 are used as transfer signals for controlling the light-emitting operations of the light-emitting thyristors Li in numerical order, while the firing signal ϕf is used as a signal for setting the light-emitting thyristors Li ready to emit light.

By replacing the second clock signal ϕ2 in the first exemplary embodiment with the firing signal ϕf, the description for the first exemplary embodiment is made applicable to the second exemplary embodiment. Moreover, this replacement allows the state transition table shown in FIG. 7 to be used as the state transition table for each light-emitting element chip 51 in the second exemplary embodiment.

Note that, though the first and second clock signals ϕ1 and ϕ2, the lighting signal ϕI and the firing signal ϕf are supplied in common to all the light-emitting element chips 51 in FIG. 9, any or all of these signals do not necessarily be supplied in common to all the light-emitting element chips 51. Instead, the multiple light-emitting element chips 51 may be divided into groups, and the signals may be supplied to the respective groups in a manner that any or all of the signals are different for each group.

As has been described above, in the second exemplary embodiment as well, by using the light-emission enable signal En to control whether or not the light-emitting thyristors Li emit light, the lighting signal ϕI is commonly used for the multiple light-emitting element chips 51. This reduces the number of current buffer circuits for supplying the lighting signals ϕI, each of which has a large current drive capability.

In addition, the light-emission enable signal En, which is supplied to the gate electrode Gt of the light-emission enable thyristor Td, functions to raise the ON voltage Von thereof for turning on the light-emission enable thyristor Td. Accordingly, the light-emission enable signal En may be supplied using a small current, unlike a large current that needs to be supplied to the anode electrode or the cathode electrode of the light-emission enable thyristor Td in order to turn it on.

As a result, in the light-emitting element head 90, the required number of current buffer circuits each having a large current drive capability is reduced, while the multiple light-emission enable signals En are supplied using a small current.

(Third Exemplary Embodiment)

Figure 13:
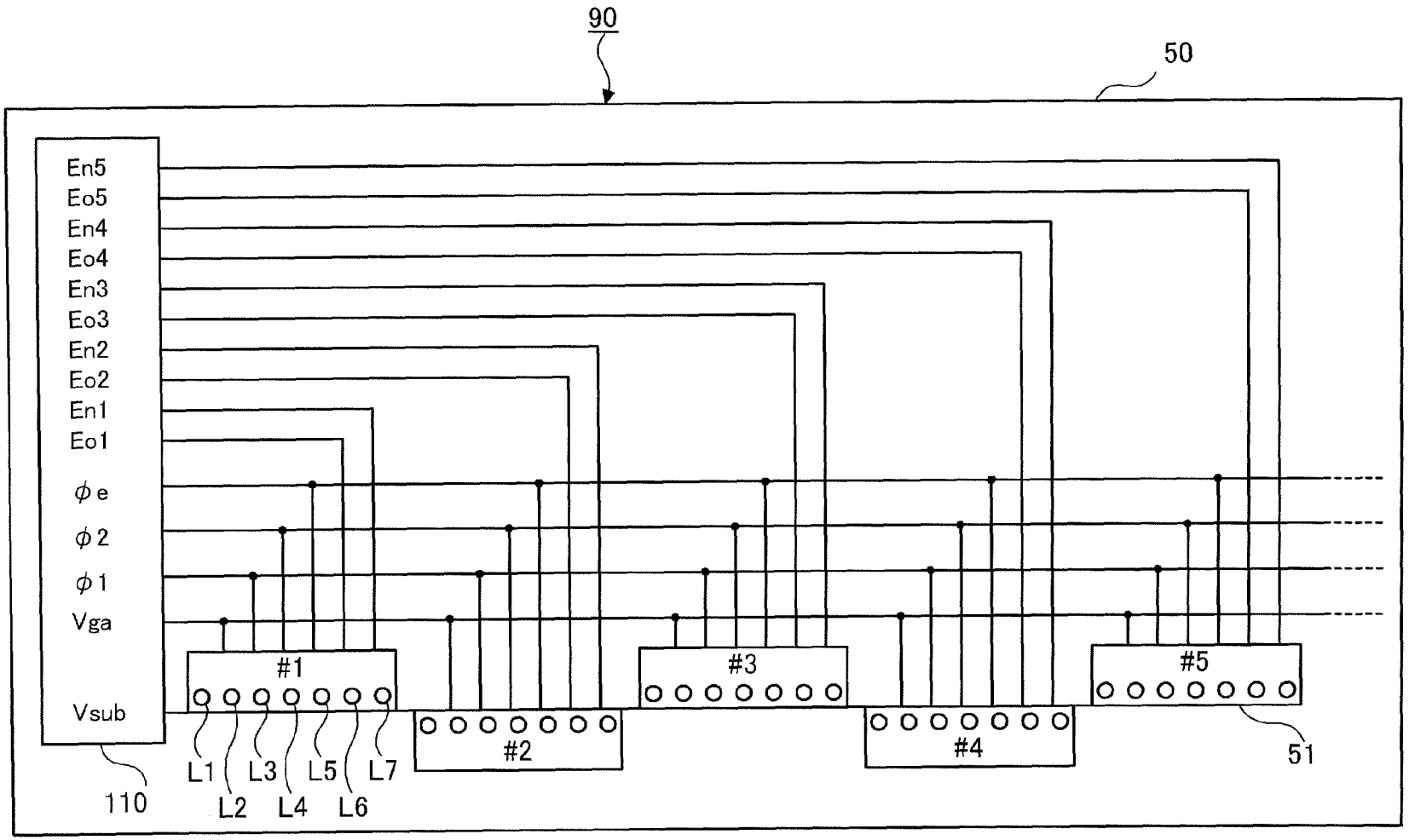
FIG. 13 is a schematic view for explaining a configuration of each light-emitting element head in the third exemplary embodiment.

FIG. 13 is a schematic view for explaining a configuration of each light-emitting element head 90 in the third exemplary embodiment.

The signal generating circuit 110 in the third exemplary embodiment supplies first to fifth extinguishment enable signals Eo1 to Eo5 in addition to the first and second clock signals ϕ1 and ϕ2, the power supply voltage Vga, the reference voltage Vsub and the first to fifth light-emission enable signals En1 to En5. In addition, the signal generating circuit 110 also supplies an extinguishing signal ϕe in place of the lighting signal ϕI. Note that the signal generating circuit 110 supplies the extinguishing signal ϕe in common to all the light-emitting element chips 51. Meanwhile, the signal generating circuit 110 supplies the mutually different extinguishment enable signals Eo, that is, the first to fifth extinguishment enable signals Eo1 to Eo5, to the respective light-emitting element chips 51.

Hereinbelow, components in the third exemplary embodiment similar to those in the first exemplary embodiment will be denoted by the same reference numerals, and the detailed description thereof will be omitted.

Figure 14:
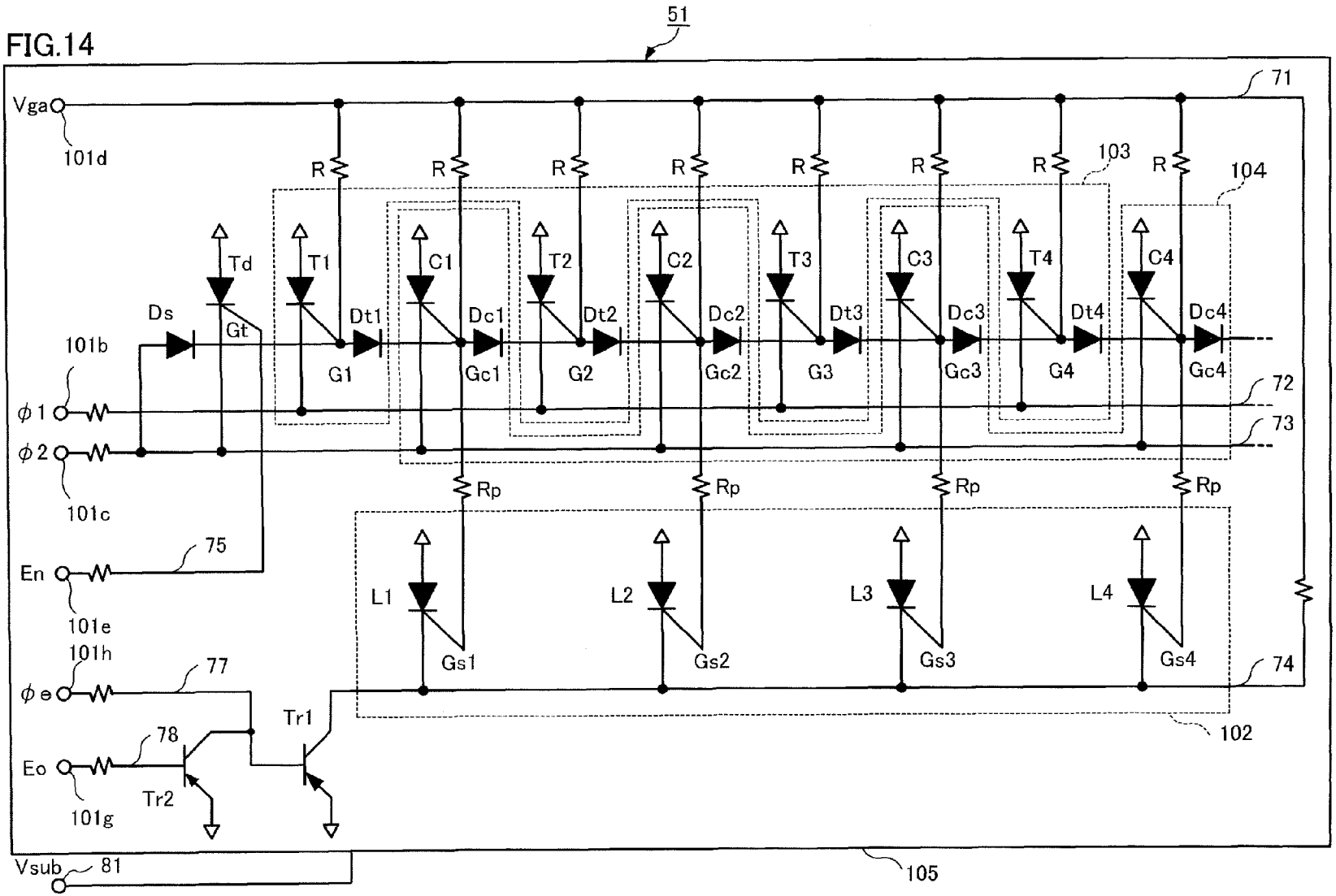
FIG. 14 is a schematic view of an equivalent circuit and a planar layout of each light-emitting element chip in the third exemplary embodiment.

FIG. 14 is a schematic view of an equivalent circuit and a planar layout of each light-emitting element chip 51 in the third exemplary embodiment.

The light-emitting element chip 51 has a configuration equivalent to the light-emitting element chip 51 in the first exemplary embodiment additionally provided with a first pnp transistor Tr1 and a second pnp transistor Tr2.

Hereinbelow, a description will be given of the connection relation of the elements in the light-emitting element chip 51 with reference to FIG. 14. In the following, only differences from the first exemplary embodiment will be described, and redundant description will be omitted.

In this light-emitting element chip 51, the power supply line 71 is connected to the lighting signal line 74 via a resistor.

The collector terminal of the first pnp transistor Tr1, which is additionally provided, is connected to the lighting signal line 74. The base terminal of the first pnp transistor Tr1 is connected both to the collector terminal of the second pnp transistor Tr2, which is additionally provided, too, and to an extinguishing signal line 77.

Meanwhile, the base terminal of the second pnp transistor Tr2 is connected to an extinguishment enable signal line 78.

The extinguishing signal line 77 and the extinguishment enable signal line 78 are connected to an extinguishing signal terminal 101*h* and an extinguishment enable terminal 101*g* via resistors, respectively.

The emitter terminals respectively of the first and second pnp transistors Tr1 and Tr2 are connected to the backside common electrode 81, and thus supplied with the reference voltage Vsub.

The extinguishing signal terminal 101*h* is supplied with the extinguishing signal ϕe, which is a signal for terminating the light-emitting state of the light-emitting thyristors Li. The extinguishment enable terminal 101*g* is supplied with one of the extinguishment enable signals Eo, each of which is a signal for controlling whether or not to extinguish the corresponding light-emitting element chip 51.

Figure 15:
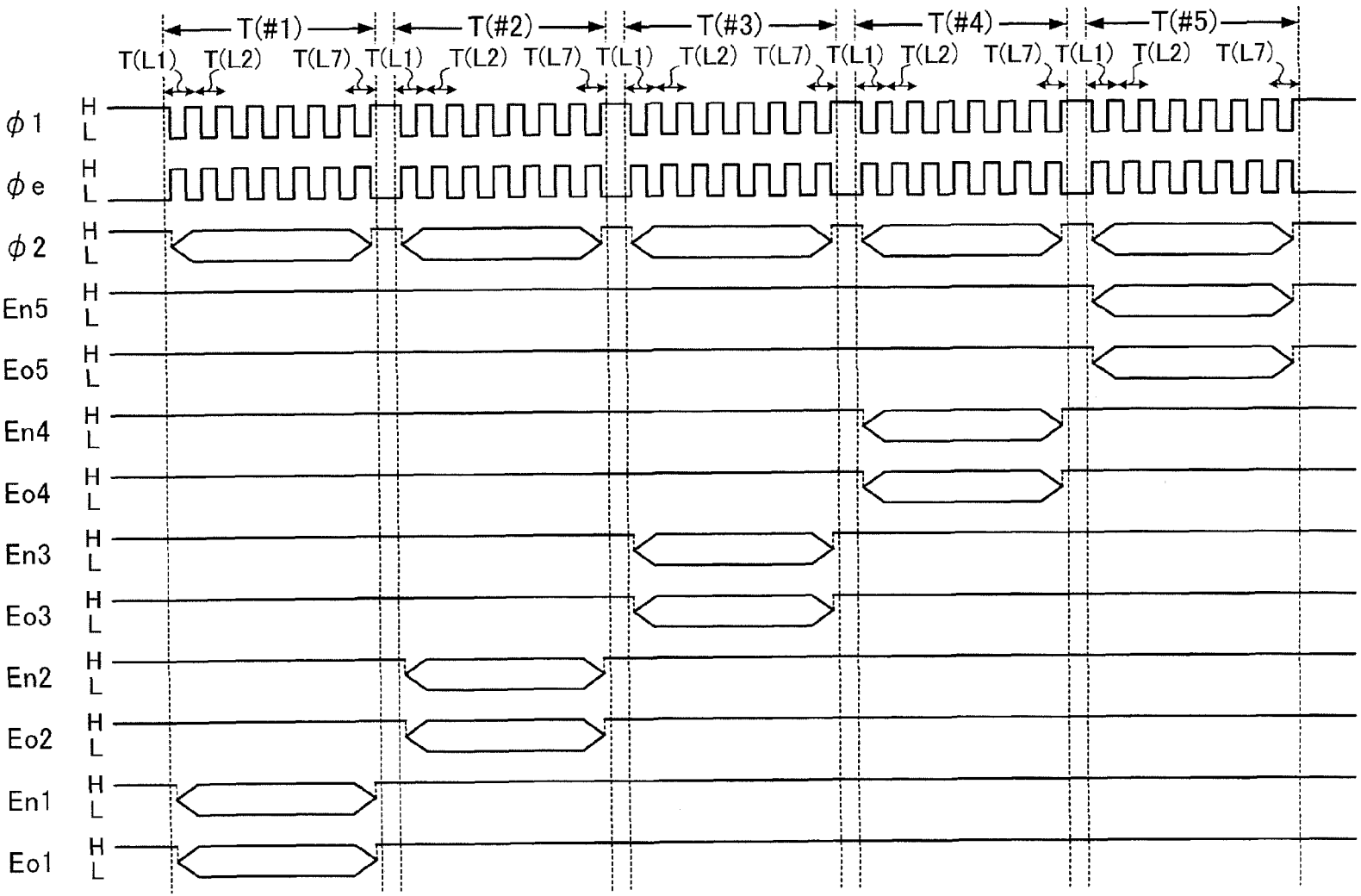
FIG. 15 is a time chart for explaining a driving method of driving each light-emitting element head in the third exemplary embodiment.

FIG. 15 is a time chart for explaining a driving method of driving each light-emitting element head 90 in the third exemplary embodiment. This driving method is comparable to the first driving method in the first exemplary embodiment shown in FIG. 5.

The signal generating circuit 110 outputs the first clock signal ϕ1 similar to that in the first exemplary embodiment. In addition, the signal generating circuit 110 outputs the extinguishing signal ϕe that repeats a pair of a transition from the L level to the H level and a transition from the H level to the L level the same number of times as the number of the light-emitting thyristors Li in the light-emitting element chip 51 (seven times) in each of the periods T(#1) to T(#5). Note that, as will be described later, in each of the periods T(L1) to T(L5), the extinguishing signal φe transitions from the L level to the H level after the first clock signal φ1 transitions from the H level to the L level, and the extinguishing signal φe transitions from the H level to the L level before the first clock signal φ1 transitions from the L level to the H level. In other words, in terms of the H level and the L level, the extinguishing signal φe in the third exemplary embodiment has the reversed waveform to that of the lighting signal φI in the first exemplary embodiment.

Additionally, the signal generating circuit 110 also outputs the first to fifth light-emission enable signals En1 to En5 and the first to fifth extinguishment enable signals Eo1 to Eo5. The first light-emission enable signal En1 and the first extinguishment enable signal Eo1 transition between the H level and the L level as necessary in the period T(#1), but are fixed at the H level in the other periods T(#2) to T(#5). The second light-emission enable signal En2 and the second extinguishment enable signal Eo2 transition between the H level and the L level as necessary in the period T(#2), but are fixed at the H level in the other periods T(#1) and T(#3) to T(#5). The third light-emission enable signal En3 and the third extinguishment enable signal Eo3 transition between the H level and the L level as necessary in the period T(#3), but are fixed at the H level in the other periods T(#1), T(#2), T(#4) and T(#5). The fourth light-emission enable signal En4 and the fourth extinguishment enable signal Eo4 transition between the H level and the L level as necessary in the period T(#4), but are fixed at the H level in the other periods T(#1) to T(#3) and T(#5). The fifth light-emission enable signal En5 and the fifth extinguishment enable signal Eo5 transition between the H level and the L level as necessary in the period T(#5), but are fixed at the H level in the other periods T(#1) to T(#4).

For example, in the period T(#1), the light-emitting operations of the light-emitting thyristors Li provided in #1 of the light-emitting element chips 51 are controlled by using the first and second clock signals φ1 and φ2, the extinguishing signal φe, the first light-emission enable signal En1 and the first extinguishment enable signal Eo1. Here, the first and second clock signals φ1 and φ2, and the extinguishing signal φe are supplied in common to #1 to #5 of the light-emitting element chips 51, while the first light-emission enable signal En1 and the first extinguishment enable signal Eo1 are supplied only to #1 of the light-emitting element chips 51. Note that #2 to #5 of the light-emitting element chips 51 are controlled in a similar manner.

Figure 16:
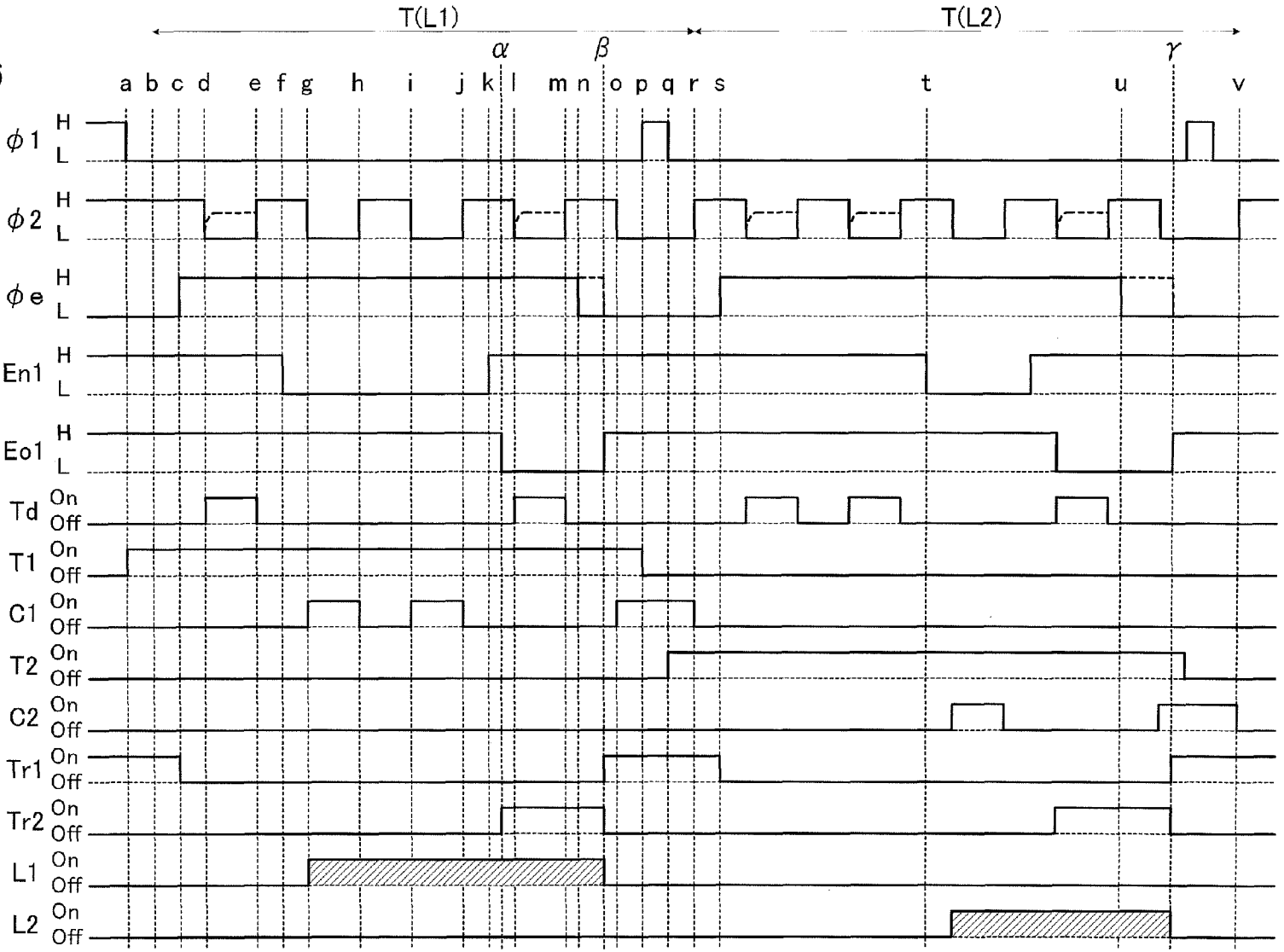
FIG. 16 is a time chart for explaining operations of the light-emitting element chips in the third exemplary embodiment.

FIG. 16 is a time chart for explaining operations of the light-emitting element chips 51 in the driving method shown in FIG. 15. Note that, in addition to the time points shown in FIG. 6, the time chart of FIG. 16 includes time points α, β and γ, which are additionally provided to explain operations of the first and second pnp transistors Tr1 and Tr2.

Here, a description will be given of an operation of one of the light-emitting element chips 51 alone, by using, as an example, #1 of the light-emitting element chips 51 whose drive control is performed in the period T(#1). Thus, in this example, among the light-emission enable signals En, the first light-emission enable signal En1 is supplied to the light-emitting element chip 51, and, among the extinguishment enable signals Eo, the first extinguishment enable signal Eo1 is supplied to the light-emitting element chip 51. Specifically, FIG. 16 illustrates light-emission control of the two light-emitting thyristors L1 and L2. In this example, the period from the time point b to the time point r is the period T(L1) for controlling the light-emitting operation of the light-emitting thyristor L1, while the period from the time point r to the time point v is the period T(L2) for controlling the light-emitting operation of the light-emitting thyristor L2.

In the period T(L1), the extinguishing signal φe is at the H level during the period from the time point c to the time point n, and at the L level during the other periods. Accordingly, the extinguishing signal φe becomes the H level after the first clock signal φ1 transitions to the L level, and becomes the L level before the first clock signal φ1 transitions to the H level. In other words, in terms of the H level and the L level, the extinguishing signal φe in the third exemplary embodiment has the reversed waveform to that of the lighting signal φI in the first exemplary embodiment.

The first extinguishment enable signal Eo1 transitions from the H level to the L level at the time point α, and transitions from the L level to the H level at the time point β. Note that the time point α has only to come at the time point c or later, while the time point β has only to come at the time point n or later but before the time point r. Here, the extinguishing signal φe becomes the H level at the time point c, the extinguishing signal φe becomes the L level at the time point n, and the light-emission control of the light-emitting thyristor L2 starts at the time point r.

Each of the extinguishing signal φe and the first extinguishment enable signal Eo1 repeats the cycle of the period T(Li).

In the following, a description will be given only for differences in operations of the light-emitting element chip 51 from the first exemplary embodiment shown in FIG. 6, and redundant description will be omitted.

In the initial state (just before the time point a), the extinguishing signal φe is set to a negative voltage (the L level), while the first extinguishment enable signal Eo1 is set to the H level (0 V).

Since the first extinguishment enable signal Eo1 is set to the H level, the potentials of the emitter terminal and the base terminal of the second pnp transistor Tr2 are both set to the H level (0 V). Accordingly, in the initial state, the second pnp transistor Tr2 is turned off and has a high resistance between the emitter terminal and the collector terminal, so that the extinguishing signal line 77 is set changeable in accordance with the extinguishing signal φe.

In this initial state, since the extinguishing signal φe is set to the L level, the first pnp transistor Tr1 is forward biased between the emitter terminal and the base terminal, thus being turned on. As a result, the collector terminal of the first pnp transistor Tr1 is set to approximately the H level of 0 V.

Though being connected to the power supply line 71 via the resistor, the lighting signal line 74 is fixed at the H level of 0 V by the first pnp transistor Tr1.

At the time point c shown in FIG. 16, the extinguishing signal φe transitions to the H level. In response, the emitter terminal and the base terminal of the first pnp transistor Tr1 are both set to the H level, and thus have approximately the same potential as each other. Accordingly, the first pnp transistor Tr1 gets turned off and has a high resistance between the emitter terminal and the collector terminal, so that the lighting signal line 74 is set to the L level of the power supply voltage Vga (−3.3 V). The lighting signal line 74 is kept at the L level from the time point c to the time point n.

This is equivalent to the condition shown in FIG. 6 where the lighting signal φI is kept at the L level from the time point c to the time point n. In other words, like the lighting signal φI shown in FIG. 6, the extinguishing signal φe functions to terminate the light-emitting state of the light-emitting thyristors Li.

Then, at the time point g, the second clock signal $\phi 2$ transitions to the L level. At this time, the light-emission enable thyristor Td is not allowed to be turned on, so that the light-emission control thyristor C1 gets turned on as described in the first exemplary embodiment. As a result, the ON voltage Von of the light-emitting thyristor L1 rises to −2.2 V. Meanwhile, the lighting signal line 74 is set to the L level (−3.3 V) as described above. Accordingly, the light-emitting thyristor L1 gets turned on, and thus starts emitting light.

Now, at the time point $\alpha$, the first extinguishment enable signal Eo1 is caused to transition from the H level to the L level. In response, the second pnp transistor Tr2 gets forward biased between the emitter terminal and the base terminal, and thus turned on. Thereby, the base terminal of the second pnp transistor Tr2 and the extinguishing signal line 77 are fixed at the H level (0 V). However, at the time point $\alpha$, the extinguishing signal $\phi e$ is set to the H level, and thus the potential of the extinguishing signal line 77 remains unchanged at the H level.

At the time point n, after the time point $\alpha$, the extinguishing signal $\phi e$ becomes the L level. However, since the extinguishing signal line 77 is fixed at the H level (0 V) by the second pnp transistor Tr2, which is turned on, the extinguishing signal $\phi e$ is not sent to the first pnp transistor Tr1. Accordingly, the extinguishing signal Te is not transmitted to the first pnp transistor Tr1, so that the first pnp transistor Tr1 remains turned off. Accordingly, the lighting signal line 74 is kept at the L level (−3.3 V). As a result, the light-emitting thyristor L1 is kept turned on, and thus continues to emit light.

At the time point $\beta$, the first extinguishment enable signal Eo1 transitions to the H level. In response, the emitter terminal and the base terminal of the second pnp transistor Tr2 are both set to the H level, and thus have approximately the same potential as each other. Accordingly, the second pnp transistor Tr2 gets turned off and has a high resistance between the emitter terminal and the collector terminal, so that the extinguishing signal line 77 is set to the L level in accordance with the extinguishing signal $\phi e$. As a result, the first pnp transistor Tr1 gets forward biased between the emitter terminal and the base terminal to be turned on, and thus fixes the lighting signal line 74 at the H level. In response, the cathode electrode and the anode electrode of the light-emitting thyristor L1 are both set to the H level, and thus have approximately the same potential as each other. As a result, the light-emitting thyristor L1 is no longer allowed to be turned on, and thus stops emitting light.

In other words, by the extinguishment enable signal Eo, the period shown in FIG. 16 during which the extinguishing signal $\phi e$ is kept at the H level is prolonged by a period from the time point n to the time point $\beta$ (this virtually-prolonged portion is expressed by the dashed line drawn in the period from the time point n to the time point $\beta$ in FIG. 16).

Here, suppose the case where the extinguishment enable signal Eo is set to the L level while any of the light-emitting thyristors Li is turned on, and thus is emitting light. In this case, the light-emitting thyristor Li does not stop emitting light as long as the extinguishment enable signal Eo is set to the L level, as has been described above. Thus, the extinguishment enable signals Eo provide not only control on whether or not to allow each light-emitting element chip 51 to stop emit light, but also control on the light-emitting period of each light-emitting thyristor Li. The latter control is achieved by adjusting the timing at which the extinguishment enable signal Eo transitions from the L level to the H level to control the time point when the light-emitting thyristor Li stops emitting light.

On the other hand, while the extinguishment enable signal Eo is set to the H level, whether or not the light-emitting element chip 51 stops emitting light is controlled by using the extinguishing signal $\phi e$.

Moreover, the control on the time point when the light-emitting thyristor Li is caused to start emitting light by using the light-emission enable signal En, which is described in the first exemplary embodiment, may be combined with the control on the time point when the light-emitting thyristor Li is caused to stop emitting light by using the extinguishment enable signal Eo. The combination allows the time point when the light-emitting thyristor Li is caused to start emitting light to be controlled independently of the time point when the light-emitting thyristor Li is caused to stop emitting light.

As shown in FIG. 16 as an example, the first light-emission enable signal En1 transitions from the H level to the L level at different timings (the time points f and t in FIG. 16) in the respective periods T(L1) and T(L2), while the first extinguishment enable signal Eo1 transitions from the L level to the H level at different timings (the time points $\beta$ and $\gamma$ in FIG. 16) in the respective periods T(L1) and T(L2). As a result, the light-emitting thyristors L1 and L2 have different light-emitting periods from each other.

As has been described above, each of the first and second pnp transistors Tr1 and Tr2 functions as a switch element that switches the potential of the lighting signal line 74 between two potentials of: allowing the light-emitting thyristors Li to continue to emit light (the L level); and not allowing the light-emitting thyristors Li to continue to emit light (the H level).

Note that the time point when the light-emitting thyristor Li stops emitting light may be set by using only the extinguishing signal $\phi e$. This eliminates the need for providing the second pnp transistor Tr2, and thus eliminates the need for any extinguishment enable signal Eo. In this case, by replacing the lighting signal $\phi I$ with the extinguishing signal $\phi e$ after interchanging the H level and the L level of the lighting signal $\phi I$ in the state transition table shown in FIG. 7, the state transition table shown in FIG. 7 is made usable as the state transition table for each light-emitting element chip 51 in the third exemplary embodiment.

Moreover, the negative voltage (the L level) of the extinguishing signal $\phi e$ and the extinguishment enable signal Eo is not limited to the power supply voltage Vga=−3.3 V, but has only to be low enough to forward bias each of the first and second pnp transistors Tr1 and Tr2 between the base terminal and the emitter terminal.

Note that the pnpn structure of each of the thyristors including the light-emitting thyristors Li is formed by sequentially stacking, on a substrate, a p-type first semiconductor layer, a n-type second semiconductor layer, a p-type third semiconductor layer and a n-type fourth semiconductor layer. Meanwhile, the first and second pnp transistors Tr1 and Tr2 may be formed of these first to third semiconductor layers, for example.

Note that, though the first and second clock signals $\phi 1$ and $\phi 2$, and the extinguishing signal $\phi e$ are supplied in common to all the light-emitting element chips 51 in FIG. 13, any or all of these signals do not necessarily be supplied in common to all the light-emitting element chips 51. Instead, the multiple light-emitting element chips 51 may be divided into groups, and the signals may be supplied to the respective groups in a manner that any or all of the signals are different for each group.

As has been described above, in the third exemplary embodiment as well, whether or not the light-emitting thyristors Li emit light is controlled by using the light-emission enable signal En. Moreover, in the third exemplary embodiment, a current for keeping the turned-on light-emitting thyristor Li emitting light is supplied via the power supply terminal 101*d*. This eliminates the need for the signal generating circuit 110 to supply a current for keeping the light-emitting thyristor Li emitting light by using any signal (the lighting signal φI in the first exemplary embodiment, for example). Accordingly, the signal generating circuit 110 need not be provided with any current buffer circuit having a large current drive capability for supplying a current for keeping the light-emitting thyristor Li emitting light.

In addition, as has been described above, the light-emission enable signal En, which is supplied to the gate electrode Gt of the light-emission enable thyristor Td, functions to raise the ON voltage Von thereof serving as a threshold value for turning on the light-emission enable thyristor Td. Accordingly, the light-emission enable signal En may be supplied using a small current, unlike a large current for turning on the light-emission enable thyristor Td.

Moreover, the extinguishing signal φe, which is supplied to the base terminal of the first pnp transistor Tr1 while the second pnp transistor Tr2 is turned off, has only to be capable of forward biasing the first pnp transistor Tr1 between the emitter terminal and the base terminal. Meanwhile, the extinguishment enable signal Eo, which is supplied to the base terminal of the second pnp transistor Tr2, has only to be capable of forward biasing the second pnp transistor Tr2 between the emitter terminal and the base terminal. In other words, to the base terminal of a pnp transistor, each of the extinguishing signal φe and the extinguishment enable signal Eo may be supplied, using a small current, unlike a large current supplied to the emitter terminal or the collector terminal thereof.

As a result, in the light-emitting element head 90, the required number of current buffer circuits each having a large current drive capability is reduced, while the multiple signals of the light-emission enable signals, the extinguishing signal and the extinguishment enable signals are supplied using a small current.

Moreover, in the third exemplary embodiment, the first and second pnp transistors Tr1 and Tr2 are provided in the light-emitting element chip 51 in the first exemplary embodiment shown in FIG. 5. However, the first and second pnp transistors Tr1 and Tr2 may be provided in the light-emitting element chip 51 in the second exemplary embodiment shown in FIG. 10.

In the above exemplary embodiments, a parasitic resistance is used as each resistor Rp. However, a resistor may be formed to be used as the resistor Rp.

Moreover, in the above exemplary embodiments, the description has been given of the case where each of the transfer thyristors, the light-emission control thyristors, the light-emitting thyristors and the light-emission enable thyristor in the light-emitting element chip is a three-terminal thyristor whose anode electrode is supplied with the reference voltage. However, if polarities of a circuit are changed, an alternative case may be employed. Specifically, each of the transfer thyristors, the light-emission control thyristors, the light-emitting thyristors and the light-emission enable thyristor may be a three-terminal thyristor whose cathode electrode is supplied with the reference voltage.

In the above exemplary embodiments, the light-emitting element chips are formed of a GaAs-based semiconductor, but the material of the light-emitting element chips is not limited to this. For example, the light-emitting element chips may be formed of another composite semiconductor, such as GaP, which is difficult to turn into a p-type semiconductor or an n-type semiconductor by ion implantation.

The light-emitting element chips in these exemplary embodiments are also applicable to a device, such as a display device, which controls light-emission of the respective light-emitting thyristors on the basis of data input from an outside, in addition to the exposure device of the image forming apparatus explained in these exemplary embodiments.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light-emitting element chip, comprising:

a substrate;

a light-emitting thyristor array that is formed on the substrate, and that has a plurality of light-emitting thyristors controlled whether or not to emit light;

a light-emission control thyristor array that is formed on the substrate, and that has a plurality of light-emission control thyristors connected respectively to the plurality of light-emitting thyristors, the plurality of light-emission control thyristors respectively specifying, as a target for controlling whether or not to emit light, the plurality of light-emitting thyristors to which the plurality of light-emission control thyristors are connected respectively when being sequentially turned on in order to be in an on state; and a light-emission enable thyristor that is formed on the substrate, and that is connected in parallel to the plurality of light-emission control thyristors, the light-emission enable thyristor preventing any of the plurality of light-emission control thyristors being in an off state from transitioning from the off state to the on state, when the light-emission enable thyristor is turned on in order to be in the on state.

2. The light-emitting element chip according to claim 1, further comprising a transfer thyristor array including a plurality of transfer thyristors that are connected respectively to the plurality of light-emission control thyristors in an alternate manner, and that cause the plurality of light-emission control thyristors to which the plurality of transfer thyristors are connected respectively to be turned on in order to be in the on state when the transfer thyristors are sequentially turned on in order to be in the on state.

3. The light-emitting element chip according to claim 2, further comprising a diode that is placed between one of the plurality of light-emission control thyristors and corresponding one of the plurality of transfer thyristors that is adjacent to the one of the plurality of light-emission control thyristors, the diode being connected both to the one of the plurality of light-emission control thyristors and to the corresponding one of the plurality of transfer thyristors.

4. The light-emitting element chip according to claim 2, further comprising:

a power supply line for supplying a power supply voltage in common to gate electrodes respectively of the plurality of transfer thyristors and the plurality of light-emission control thyristors;

a lighting signal line that is connected to the power supply line via a resistor, and connected in common to any of anode electrodes and cathode electrodes of the plurality of light-emitting thyristors; and a switch element that is connected to the lighting signal line, and that switches a potential of the lighting signal line between a potential of allowing the light-emitting thyristors to continue to emit light and a potential of not allowing the light-emitting thyristors to continue to emit light.

5. The light-emitting element chip according to claim 1, further comprising a transfer thyristor array including a plurality of transfer thyristors that are connected to one another and respectively to the plurality of light-emission control thyristors, and that cause the plurality of light-emission control thyristors to which the plurality of transfer thyrstors are connected respectively to be each turned on in order to be in the on state when being sequentially turned on in order to be in the on state.

6. The light-emitting element chip according to claim 5, further comprising:

a diode that is placed between two of the plurality of transfer thyristors, and that is connected to the two of the plurality of transfer thyristors; and another diode that is placed between one of the plurality of transfer thyristors and corresponding one of the plurality of light-emission control thyristors that is connected to the one of the plurality of transfer thyristors, the another diode being connected both to the one of the plurality of transfer thyristors and the corresponding one of the plurality of light-emission control thyristors.

7. The light-emitting element chip according to claim 1, further comprising:

a signal line to which a signal for turning on any one of the light-emission control thyristors and the light-emission enable thyristor in order to be in the on state is inputted; and an input terminal from which the signal is inputted to the signal line, wherein anode electrodes of the plurality of light-emission control thyristors are connected to an anode electrode of the light-emission enable thyristor, cathode electrodes of the plurality of light-emission control thyristors are connected to a cathode electrode of the light-emission enable thyristor, and any one of the anode electrode and the cathode electrode of the light-emission enable thyristor is connected to the signal line at a position closer to the input terminal than any of the anode electrodes and the cathode electrodes of the plurality of light-emission control thyristors is.

8. A light-emitting device, comprising:

a light-emitting thyristor array that includes a plurality of light-emitting thyristors each having an anode electrode, a cathode electrode and a gate electrode, each of the plurality of light-emitting thyristors emitting light by transitioning from an off state to an on state, each of the plurality of light-emitting thyristors conducting between the anode electrode and the cathode electrode when turned on in order to be in the on state, while not conducting when turned off in order to be in the off state;

a setting unit that switches a potential difference between the anode electrode and the cathode electrode of each of the plurality of light-emitting thyristors alternately between a first potential difference and a second potential difference so that the plurality of light-emitting thyristors are caused to have one of the first potential difference and the second potential difference in common, the second potential difference having a larger absolute value than the first potential difference;

a specifying unit that sequentially specifies, as a target for controlling whether or not to emit light, one light-emitting thyristor from the plurality of light-emitting thyristors, the specifying unit including a plurality of light-emission control thyristors that are connected respectively to the plurality of light-emitting thyristors, and that specifies, as the one light-emitting thyristor, one of the light-emitting thyristors to which one of the light-emission control thyristors is connected, when the one of the light-emission control thyristors is turned on in order to be in the on state;

a supply unit that alternately supplies a transition voltage and a maintaining voltage to the gate electrode of one light-emitting thyristor specified as the target by the specifying unit, in a light-emission control period during which the specifying unit specifies the one light-emitting thyristor as the target, and during which the setting unit causes the plurality of light-emitting thyristors to have the second potential difference, the transition voltage being a voltage for causing the one light-emitting thyristor to transition from the off state to the on state, the maintaining voltage being a voltage for keeping the one light-emitting thyristor being in the off state; and an adjusting unit that adjusts a light-emitting period of the one light-emitting thyristor by supplying the gate electrode of the one light-emitting thyristor with the maintaining voltage instead of the transition voltage to prevent the one light-emitting thyristor from starting emitting light in the light-emission control period, and by stopping supplying the maintaining voltage at a variable timing in the light-emission control period, the adjusting unit including a light-emission enable thyristor that is connected in parallel to the plurality of light-emission control thyristors, and that prevents each of the plurality of light-emission control thyristors being in the off state from transitioning from the off state to the on state, when the light-emission enable thvristor is turned on in order to be in the on state.

9. The light-emitting device according to claim 8, wherein the specifying unit includes:

a plurality of transfer thyristors that are connected respectively to the plurality of light-emission control thyristors, and that cause the plurality of light-emission control thyristors to which the plurality of transfer thyristors are connected respectively to be each turned on in order to be in the on state when the transfer thyristors are sequentially turned on in order to be in the on state.

10. A light emission adjusting method for a light-emitting thyristor array including a plurality of light-emitting thyristors each having an anode electrode, a cathode electrode and a gate electrode, each of the plurality of light-emitting thyristors emitting light by transitioning from an off state to an on state, each of the plurality of light-emitting thyristors conducting between the anode electrode and the cathode electrode when turned on in order to be in the on state, while not conducting when turned off in order to be in the off state, the light emission adjusting method comprising:

switching a potential difference between the anode electrode and the cathode electrode of each of the plurality of light-emitting thyristors alternately between a first potential difference and a second potential difference so that the plurality of light-emitting thyristors are caused to have one of the first potential difference and the second potential difference in common, the second potential difference having a larger absolute value than the first potential difference;

sequentially specifying, as a target for controlling whether or not to emit light, one light-emitting thyristor from the plurality of light-emitting thyristors, the one light-emitting thyristor being one of the light-emitting thyristors to which one of a plurality of light-emission control thvristors is connected, when the one of the light-emission control thyristors is turned on in order to be in the on state;

alternately supplying a transition voltage and a maintaining voltage to the gate electrode of one light-emitting thyristor specified as the target, in a light-emission control period during which the one light-emitting thyristor are specified as the target, and during which the plurality of light-emitting thyristors are caused to have the second potential difference, the transition voltage being a voltage for causing the one light-emitting thyristor to transition from the off state to the on state, the maintaining voltage being a voltage for keeping the one light-emitting thyristor being in the off state;

adjusting a light-emitting period of the one light-emitting thyristor by supplying the gate electrode of the one light-emitting thyristor with the maintaining voltage instead of the transition voltage to prevent the one light-emitting thyristor from starting emitting light in the light-emission control period, and by stopping supplying the maintaining voltage at a variable timing in the light-emission control period; and preventing each of the plurality of light-emission control thvristors being in the off state from transitioning from the off state to the on state, when a light-emission enable thyristor that is connected in parallel to the plurality of light-emission control thyristors is turned on in order to be in the on state.

* * * * *